US005104775A

United States Patent [19]

Abe et al.

[11] Patent Number: 5,104,775

[45] Date of Patent: Apr. 14, 1992

[54] METHOD FOR PROCESSING SILVER HALIDE COLOR PHOTOGRAPHIC LIGHT SENSITIVE MATERIALS

[75] Inventors: Akira Abe; Shinji Ueda; Toshihiro Nishikawa, all of Minami-Ashigara, Japan

[73] Assignee: Fuji Photo Film Co., Ltd., Minami-Ashigara, Japan

[21] Appl. No.: 758,416

[22] Filed: Sep. 4, 1991

Related U.S. Application Data

[63] Continuation of Ser. No. 282,268, Dec. 9, 1988, abandoned.

[30] Foreign Application Priority Data

Dec. 11, 1987 [JP] Japan ..... 62-313406

[51] Int. Cl.[5] ..... G03C 7/40

[52] U.S. Cl. ..... 430/372; 430/393; 430/400; 430/428; 430/460

[58] Field of Search ..... 430/372, 393, 400, 428, 430/460

[56] References Cited

U.S. PATENT DOCUMENTS

| | | | |
|---|---|---|---|
| 3,369,896 | 2/1968 | Seamann et al. | 430/463 |
| 4,059,446 | 11/1977 | Hazenboson et al. | 430/429 |
| 4,778,743 | 10/1988 | Ishikawa et al. | 430/463 |
| 4,789,626 | 12/1988 | Sakanoue et al. | 430/372 |

FOREIGN PATENT DOCUMENTS 147148 7/1985 European Pat. Off. .

OTHER PUBLICATIONS

Derwent Abstracts J61 134759, "Automatic Developing . . .", 6/86, Konishiroku Photo KK.

Derwent Abstract J58 095342, "Continuous Treatment . . .", 6/83, Konishiroku Photo KK.

*Primary Examiner*—Hoa Van Le

*Attorney, Agent, or Firm*—Burns, Doane, Swecker & Mathis

[57] ABSTRACT

In a method for processing at least 2 kinds of silver halide color photographic light-sensitive materials comprising the steps of development, bleach-fixing, water washing and/or stabilization, the method comprises processing, in a common bleach-fixing bath and a common water washing or stabilization bath directly subsequent thereto, one silver halide color photographic light sensitive material having, applied to a substrate, a silver halide emulsion layer which contains, on average, not less than 3 mole % of silver iodide and another silver halide color photographic light sensitive material having applied to a substrate a silver halide emulsion layer which is substantially free of silver iodide, the water washing or stabilization bath containing at least one nonionic surfactant. The amount of replenisher for the bleach-fixing bath and the water washing or stabilizing bath is reduced to not more than 400 ml/m$^2$ for color paper or not more than 800 ml/m$^2$ for color negative film. The method makes it possible to simultaneously process different color light-sensitive materials such as color negative films and color paper and to thereby reduce the space required for installing an automatic developing machine.

15 Claims, 1 Drawing Sheet

METHOD FOR PROCESSING SILVER HALIDE COLOR PHOTOGRAPHIC LIGHT SENSITIVE MATERIALS

Figure 1:
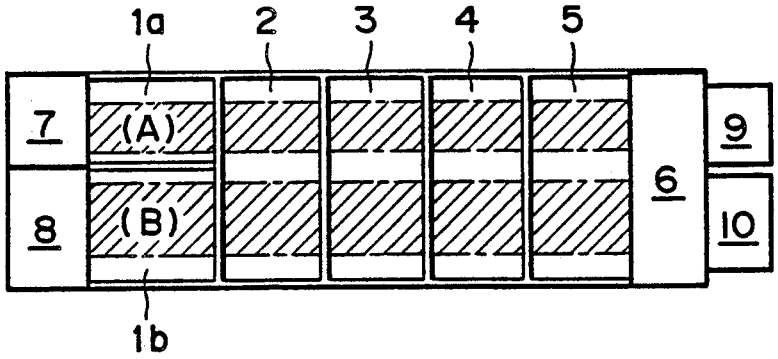

This application is a continuation of application Ser. No. 07/282,268, filed Dec. 9, 1988, now abandoned.

BACKGROUND OF THE INVENTION

The present invention relates to a method for processing silver halide color photographic light-sensitive materials and more particularly to a method for processing at least two materials in which a color light-sensitive material provided thereon with a coated emulsion layer having a silver iodide content of not less than 3 mole % and another color light-sensitive material provided thereon with a coated emulsion layer substantially free of silver iodide can be processed in the common (same) processing solutions, whereby the size of a processing apparatus can be minimized and the operations thereof can be simplified.

Silver halide color photographic light-sensitive materials (hereinafter referred to as "color light-sensitive material (s)") can be roughly classified into the following two groups: photographic color light-sensitive materials represented by color negative films, and color light-sensitive materials for prints represented by color paper. These color light-sensitive materials have conventionally been processed only in large-scale photofinishing laboratories, but recently a small-sized processing system called "Minilabo" has been developed and thus they are now processed even in a photography shop.

For such small-sized processing systems, it is of primary importance that they require a small area for installation and a small working space since they are generally installed in a small space such as a shop. For this reason, there has been a strong need for the development of a processing method which allows an automatic developing machine comprising a processing system to minimize and simplify processing operations.

Responding to the aforementioned demands, Japanese Patent Un-examined Publication (hereunder referred to as "J.P. KOKAI") Nos. 60-129747, 60-129748 and 61-134759 propose integrated automatic developing machines which can simultaneously process color light-sensitive materials for taking photographs and color light-sensitive materials for prints, conventionally processed separately, in the same processing baths during a part or whole of the processing. If such an idea could be realized, the foregoing two kinds of color light-sensitive materials could indeed be processed simultaneously with one automatic developing machine, and the space for installation thereof could be reduced substantially and the operations simplified since the number of processing solutions to be used could be minimized. However, the foregoing patents simply propose the simultaneous processing of different kinds of color light-sensitive materials and do not disclose solutions of the problems associated with such a simultaneous processing.

The color light-sensitive materials for print such as color paper are generally formed using a silver chlorobromide, silver chloride or silver bromide emulsion substantially free of silver iodide (average AgI content thereof: not more than 1 mole %). On the contrary, color light-sensitive materials for taking photographs such as color negative films are obtained using a silver iodobromide emulsion having an average AgI content of not less than 3 mole % for the purposes of enhancing the sensitivity and graininess of the resultant light-sensitive layers. In this regard, the term "average AgI content" herein means the ratio (expressed in "mole %") of the total amount of silver iodide to the total amount of silver halide included in the light-sensitive emulsion layer.

It has gradually become clear that various problems arise when light-sensitive materials greatly different in their halogen compositions including such silver iodide contents are simultaneously processed in the same processing solution.

Particularly, the inventors have found that serious stains of color paper are observed when the simultaneous processing of color negative films and color paper is continuously carried out. This is a serious problem to be solved to make such a simultaneous processing practically applicable.

It is found that the foregoing problem becomes noticable, in particular in cases where such a simultaneous treatment is carried out in a bleach-fixing bath and a water washing bath or a stabilization bath directly subsequent thereto and more particularly in cases where the amount of replenisher for the bleach-fixing bath and the water washing or stabilization bath is reduced to not more than 400 ml/m$^2$ for color paper or not more than 800 ml/m$^2$ for color negative films. Such stains are mainly caused by the interaction between sensitizing dyes derived from the color negative films and iodides likewise derived from color negative films which are dissolved into .the bleach-fixing bath to thereby cause dying of the color paper.

The bleach-fixing bath is very important in simplifying the processing of color light-sensitive materials since it allows one step to be simultaneously bleached and fixed. It is also effective for simplifying the processing operations and for reducing the expenses and labor required for the pretreatment of waste liquor to carry out, subsequent to the bleach-fixing process, water washing or stabilization process in which the amount of replenisher is greatly saved. Accordingly, there is a strong need, in this field, for the development of a method for simultaneously processing at least two different color light-sensitive materials wherein a bleach-fixing bath is used and processing is carried out in a replenisher-saving manner.

SUMMARY OF THE INVENTION

A primary object of the present invention is to simplify the processing of light-sensitive materials by enabling treatment of at least two color light-sensitive materials for taking photographs and those for prints, which greatly differ in their silver iodide contents, in a common bleach-fixing bath and a common water washing or stabilization bath.

Another object of the present invention is to provide a method for processing such different color light-sensitive materials and to thereby minimize the size of an automatic developing machine and simplify the construction thereof.

A further object of the present invention is to provide a method for processing such different color light-sensitive materials, which can be carried out under replenisher-saving conditions, thereby simplifying the processing and also substantially reducing the processing expenses.

The inventors of the present invention have conducted various studies to solve the foregoing problems associated with the conventional simultaneous processing of different color light-sensitive materials and have found that the aforementioned and other objects can effectively be accomplished by providing the following method.

In a method for processing at least 2 kinds of silver halide color photographic light-sensitive materials comprising the steps of development, bleach-fixing, water washing and /or stabilization, the method comprises processing, in a common bleach-fixing bath and a common water washing or stabilization bath directly subsequent thereto, one silver halide color photographic light sensitive material having, applied to a substrate, a silver halide emulsion layer which contains, on average, not less than 3 mole % of silver iodide and another silver halide color photographic light sensitive material having applied to a substrate, a silver halide emulsion layer which is substantially free of silver iodide, the water washing or stabilization bath containing at least one nonionic surfactant.

BRIEF EXPLANATION OF THE ATTACHED DRAWINGS

Figure 2:
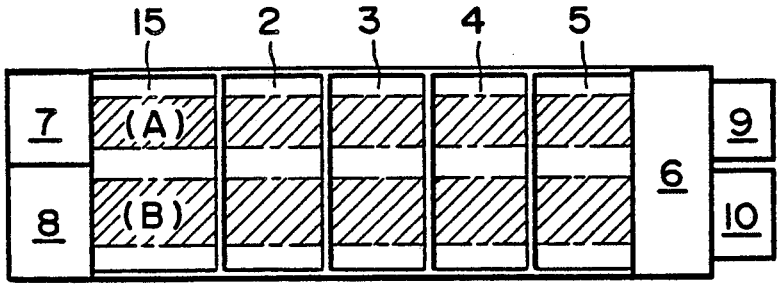

FIGS. 1 and 2 are plan views illustrating the arrangement of processing baths of automatic developing machines for processing color light-sensitive materials, used in the processing method of the present invention.

DETAILED EXPLANATION OF THE INVENTION

The term, "substantially free of silver iodide"herein means that the concerned silver halide emulsion layer has a silver iodide content of not more than one mole %, preferably 0.3 mole %, more preferably not more than 0.1 mole % and most preferably absolutely zero.

The present invention will hereunder be explained principally in terms of color negative films as an example of color light-sensitive material having an average silver iodide content of not less than 3 mole % and principally in terms of color paper as an example of color light-sensitive material substantially free of silver iodide, but the present invention is not restricted to these specific ones.

In the present invention, the term processing in common bath includes not only those in which different kinds of color light-sensitive materials are simultaneously processed in at least one processing bath of an automatic developing machine as described in J.P. KOKAI No. 60-129747 but also processings in which different kinds of color light-sensitive materials are simultaneously processed in separate processing baths of one or two automatic developing machines, the overflow from one bath for processing one of these color light-sensitive materials being introduced into the other processing bath. In the method of the present invention, the processing in the common bath is carried out in a common (i.e.,same) bleach-fixing bath and a common water washing or stabilization bath directly subsequent to the bleach-fixing bath. In this regard, the term "directly"means that no other bath lies therebetween.

According to the method of this invention, the processing in common bath can likewise be carried out in processes other than a bleach-fixing and water washing or stabilization processe. Examples of such processes are color development processes and stopping processes.

Typical examples of arrangements of processings employed in the method of the present invention are as follows, but the present invention is not restricted to these specific ones:

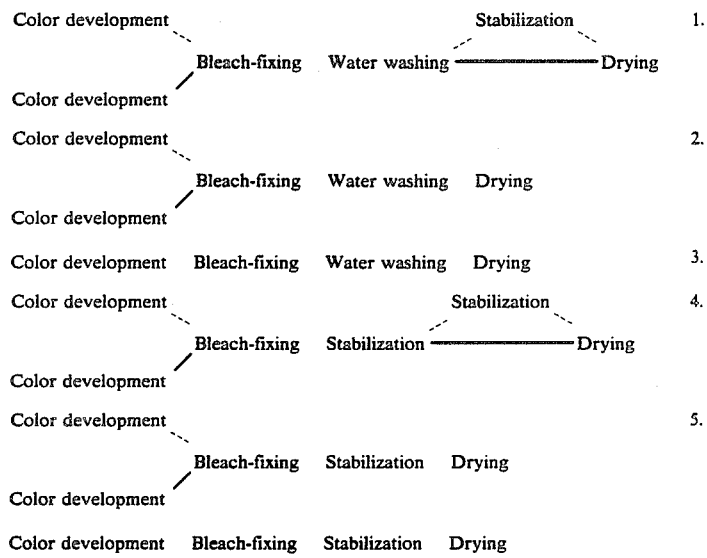

The dotted lines represent processes for color negative films while solid lines correspond to those for the color paper.

Moreover, the term "nonionic surfactant(s)" as used herein means non-ionic surfactants which are not ionized in an aqueous medium and examples thereof include ethylene oxide adducts of alcohols, alkyl phenols, aliphatic acids, polyhydric alcohols such as sorbitan and aliphatic acid amides. Among these, those represented by the following general formula (I) are preferred:

$$R—O—(CH_2CH_2O)_p—H \quad (I)$$

In the general formula (I), R represents and alkyl group, and alkenyl group, and aryl group or and alkylcarbonyl group and p is and integer ranging from 3 to 100.

Preferred ethylene oxide aducts represented by the general formula (I) are those in which R is and aryl group, particularly a phenyl group substituted, at p-position, with an alkyl group having 4 to 20 carbon atoms; or and alkyl group having 5 to 20 carbon atoms, particularly a linear alkyl group having 8 to 16 carbon atoms. On the other hand, p is preferably 5 to 50 and more preferably 5 to 25. Specific examples of preferred surfactants usable in the invention are as follows, but the present invention is not restricted to these specific examples.

(1) $n—C_6H_{13}—O—(CH_2CH_2O)_5—H$
(2) $n—C_6H_{13}—O—(CH_2CH_2O)_{10}—H$
(3) $n—C_6H_{13}—O—(CH_2CH_2O)_{50}—H$
(4) $n—C_8H_{17}—O—(CH_2CH_2O)_5—H$
(5) $n—C_8H_{17}—O—(CH_2CH_2O)_{15}—H$
(6) $n—C_8H_{17}—O—(CH_2CH_2O)_{30}—H$
(7) $n—C_{10}H_{21}—O—(CH_2CH_2O)_{10}—H$
(8) $n—C_{10}H_{21}—O—(CH_2CH_20)_{15}—H$
(9) $n—C_{12}H_{25}—O—(CH_2CH_2O)_5—H$
(10) $n—C_{12}H_{25}—O—(CH_2CH_2O)_{15}—H$
(11) $n—C_{12}H_{22}—O—(CH_2CH_2O)_{30}—H$
(12) $n—C_{12}H_{25}—O—(CH_2CH_2O)_{40}—H$
(13) $n—C_{12}H_{25}—O—(CH_2CH_2O)_{50}—H$
(14) $n—C_{14}H_{29}—O—(CH_2CH_2O)_5—H$
(15) $n—C_{14}H_{29}—O—(CH_2CH_2O)_{15}—H$
(16) $n—C_{14}H_{29}—O—(CH_2CH_2O)_{40}—H$
(17) $n—C_{16}H_{33}—O—(CH_2CH_2O)_5—H$
(18) $n—C_{16}H_{33}—O—(CH_2CH_2O)_{15}—H$
(19) $n—C_{16}H_{33}—O—(CH_2CH_2O)_{40}—H$
(20) $n—C_{16}H_{33}—O—(CH_2CH_2O)_{50}—H$
(21) $n—C_{18}H_{35}—O—(CH_2CH_2O)_5—H$
(22) $n—C_{18}H_{35}—O—(CH_2CH_2O)_{15}—H$
(23) $n—C_{18}H_{35}—O—(CH_2CH_2O)_{40}—H$
(24) $n—C_{20}H_{39}—O—(CH_2CH_2O)_{15}—H$
(25) $t—C_4H_9—Phe—O—(CH_2CH_2O)_5—H$
(26) $t—C_4H_9—Phe—O—(CH_2CH_2O)_{10}—H$
(27) $n—C_9H_{19}—Phe—O—(CH_2CH_2O)_5—H$
(28) $n—C_9H_{19}—Phe—O—(CH_2CH_2O)_8—H$
(29) $n—C_9H_{19}—Phe—O—(CH_2CH_2O)_{10}H$
(30) $n—C_9H_{19}—Phe—O—(CH_2CH_2O)_{20}—H$
(31) $n—C_{12}H_{25}—phe—O—(CH_2CH_2O)_{15}—H$
(32) $n—C_{12}H_{25}—Phe—O—(CH_2CH_2O)_{30}—H$
(33) $n—C_{16}H_{33}—Phe—O—(CH_2CH_2O)_{20}—H$
(34) $n—C_7H_{15}—CO—O—(CH_2CH_2O)_{10}—H$
(35) $n—C_{11}H_{23}—CO—O—(CH_2CH_2O)_5—H$
(36) $n—C_{11}H_{13}—CO—O—(CH_2CH_2O)_{15}—H$
(37) $n—C_{11}H_{23}—CO—O—(CH_2CH_2O)_{30}—H$
(38) $n—C_{13}H_{27}—CO—O—(CH_2CH_2O)_{15}—H$
(39) $n—C_{15}H_{31}—CO—O—(CH_2CH_2O)_{15}—H$
(40) $n—C_{15}H_{31}—CO—O—(CH_2CH_2O)_{30}—H$ In the above formulae, Phe represents phenyl group.

Each processing of the method of the present invention and processing solutions used will now be explained in detail below.

The color developer used in the invention is preferably an aqueous alkaline solution containing aromatic primary amine color developing agents. Preferred color developing agents are p-phenylenediamine type compounds and typical examples thereof include 3-methyl-4-amino-N,N-diethylaniline, 3-methyl-4-amino-N-ethyl-N-(beta-hydroxyethyl)-aniline, 3-methyl-4-amino-N-ethyl-N-(beta-methanesulfonamidoethyl)-aniline, 3-methyl-4-amino-N-ethyl-N-(beta-methoxyethyl)-aniline and sulfates, hydrochlorides, phosphates and p-toluenesulfonates thereof. The salts of these diamines are generally more stable than those in a free state and, therefore, they are preferably used in such a salt form. Particularly preferred color developing agents are as follows:

(1) 3-methyl-4-amino-N-(beta-hydroxyethyl)-aniline, and
(2) 3-methyl-4-amino-N-ethyl-N-(beta-methanesulfonamidoethyl)-aniline.

Depending on the purpose, it is optionally preferred to use both of these in combination.

In the method of this invention, processing may also be carried out in the color development. In such cases, color developing agent (1) is preferably used alone or in combination with color developing agent (2).

The color developing agents are generally used in an amount ranging form 1 to 15 g per liter of color developer, preferably 2 to 10 g/l and more particularly 3 to 8 g/l.

The color developer may contain various preservatives, for instance, a hydroxylamine such as hydroxylamine and diethyl hydroxylamine; hydradines; an aromatic polyhydroxy compound such as catechol disulfonic acid and catechol trisulfonic acid; polyethylenediamine(1,4diazabicyclo(2,2,2)octane); sulfites and bisulfites. The color developer may contain various metal-chelate forming compounds which serve as a preservative and a dispersing agent, typical examples of which include such aminopolycarboxylic acids as ethylenediaminetetraacetic acid, diethylenetriaminepentaacetic acid, hydroxyethylimino-diacetic acid and cyclohexanediaminetetraacetic acid; such aminopolyphosphonic acids as ethylenediamine tetramethylene phosphonic acid and nitrilotrimethylene phosphonic acid; and such alkylidene diphosphonic acids as 1-hydroxyethylidene-1,1-diphosphonic acid.

In addition to the foregoing components, the color developing may further comprises color development promotors such as benzylalcohol, polyethylene glycol, quaternary ammonium salts, amines and 3,6-thiaoctane-1,8-diol; auxiliary developing agents such as 1-phenyl-3-pyrazolidone; compounds competing with the color developing agents such as citrazinic acid and hydroquinone; antifoggants and development inhibitors such as bromides, iodides, benzimidazoles and benzothiazoles; pH buffering agents such as carbonates, borates and phosphates; and optionally diaminostilbene type fluorescent brighteners in accordance with the intended purposes.

The pH value of the color developer is generally adjusted to 9 to 12 and more frequently 9.5 to 10.5. The color development processing is usually carried out while supplementing color developer and the typical amount thereof to be replenished ranges form 100 to 300 $ml/m^2$ for color paper and 400 to 1,200 $ml/m^2$ for color negative films. When reducing the amount of the replenisher for the color developer, the bromide content of the replenisher is preferably not more than 0.004 mole/l. In the replenisher-saving processing, the contact area between the processing solution and air should be reduced as low as possible to prevent evaporation and oxidation of the processing solution.

The temperature of the color development in the present invention generally ranges form 25° to 45° C., preferably 30° to 40° C. On the other hand, the processing time may vary depending on the kind of the color light-sensitive materials to be treated, but for the treatment of color paper it ranges from 30 seconds to 4 minutes and 30 to 100 seconds in rapid processing, and for color negative films it ranges from 1 to 4 minutes and likewise 1 to 2.5 minutes in rapid processing.

In the method of the present invention, the color developed color negative films and color paper are simultaneously processed in a bleach-fixing bath. As bleaching agents used in the bleach-fixing solution, there may be mentioned, for instance, compounds of multivalent metals such as iron(III), cobalt(III), chromium(IV) and copper(II), peracids, quinones, and nitro compounds and particularly preferred are organic acid complex salts of iron(III). Specific examples of preferred complex salts of iron(III) include those with aminopolycarboxylic acids such as ethylenediaminetetraacetic acid, diethylenetriaminepentaacetic acid, cyclohexanediaminetetraacetic acid, 1,3-deaminopropanetetraacetic acid, methyliminodiacetic acid and glycol ether diamine tetraacetic acid. These complexes can be used in various combination thereof as disclosed in Research Disclosure No. 24023 (April, 1984).

The amount of the bleaching agents in the bleach-fixing solution generally ranges form 0.05 to 0.5 mole/l and preferably 0.1 to 0.4 mole/l.

The bleach-fixing solution preferably contains bleaching accelerators for the purpose of rapid processing. Preferred examples thereof include compounds having mercapto groups or disulfide bonds as disclosed in U.S. Pat. No. 3,893,858, West German Patent No. 1,290,812,J.P. KOKAI No. 53-95630 and Research Disclosure No. 17,129 (July, 1978); halides as disclosed in J.P. KOKOKU No. 53-11854; and compounds disclosed in U.S. Pat. No. 4,552,834. These bleaching accelerators are added to the bleach-fixing solution in an amount ranging from 0.001 to 0.05 mole/l.

Fixing agents herein used are, for instance, thiosulfates, thioethers, thiourea and iodides. Thiosulfates are most frequently used and ammonium thiosulfate is particularly preferred. The fixing agents are used in an amount ranging form 0.3 to 3 mole, preferably 0.5 to 2 mole per liter of the bleach-fixing solution.

The bleach-fixing solution used in the invention may also contain sulfites, bisulfites and/or carbonylbisulfite adducts as a preservative for the thiosulfates.

The pH value of the bleach-fixing solution can be adjusted to 3 to 9, but in general it preferably ranges from 4 to 8. In rapid processing, it is preferably adjusted to 4 to 6.

The bleach-fixing processing is carried out at a temperature ranging from 25° to 45° C., preferably 30° to 40° C. However, it is preferably established at a high temperature in cases where rapid processing is required. The processing time may vary depending on the color light-sensitive materials to be processed. For instance, for color paper it ranges from 20 seconds to 2 minutes and from 20 seconds to one minute in rapid processing, and for color negative films it ranges from 1 to 5 minutes and form 1 to 3 minutes rapid processing.

In the method of the present invention, the bleach-fixing processing is also carried out while supplementing the replenisher therefor. The amount thereof ranges from 20 to 300 ml/m$^2$ for color paper and 100 to 1,200 ml/m$^2$ for color negative films. The . amount of replenisher is preferably as small as possible in the light of the objects of the present invention and more specifically is not more than 200 ml/m$^2$for color paper and not more than 800 ml/m$^2$ for color negative films.

The bleach-fixing process in general comprises one bath, but the amount of the replenisher can further be reduced by constituting the bleach-fixing process from a plurality of baths and supplementing the replenisher in a multistage countercurrent system.

In the present invention, non-ionic surfactants are added to a water washing or stabilization bath directly subsequent to the bleach-fixing bath. The water washing bath herein means a bath for washing color light-sensitive materials to ensure desired properties of the materials after processing while the stabilization bath means a bath to which stabilizers are added in order to impart, to the processed color light-sensitive materials, image stability which cannot be achieved by the washing bath.

The amount of the non-ionic surfactants ranges form $1\times10^{-5}$ to $5\times10^{-3}$ moles and preferably $5\times10^{-5}$ to $1\times10^{-3}$ moles per liter of water washing solution or stabilization solution. Quite excellent results can be obtained if non-ionic surfactants are likewise added to the bleach-fixing solution. In the latter cases, an unexpected effect such as that the desilvering properties of the color paper is enhanced is simultaneously achieved. The non-ionic surfactants can be added to the bleach-fixing solution in the same amount as defined above. Alternatively, the addition of non-ionic surfactants to the bleach-fixing bath can be attained by introducing, into the bleach-fixing bath, overflow from the water washing or stabilization bath containing the same.

It is preferred that the water washing or stabilization process comprises a plurality of baths and that the supplementation of the replenisher therefor is effected in a multistage countercurrent system from the last bath to the first bath. The number of baths in the water washing or stabilization process is in general 2 to 6, preferably 2 to 4.

It is preferred to prepare water washing or stabilization solution utilizing deionized water as disclosed in Japanese Patent Application Serial (hereunder referred to as "J.P.A.") No. 61-131632. In addition, the water washing or stabilization solution may contain antibacterial agents or antifungus agents such as thiabendazoles, benzotriazoles and chlorinated isocyanuric acid salts in addition to isothiazolone type compounds as disclosed in J.P. KOKAI No. 57-8542. Moreover, the solutions may comprise other additives such as softeners for hard water such as ethylenediaminetetraacetic acid and fluorescent brighteners.

To the stabilization solution, there is in general added image stabilizing agents such as formalin and ammonium salts other than the aforementioned components.

The pH value of the water washing and stabilization baths generally ranges form 5 to 9, and preferably 6 to 8. The processing time in the water washing or stabilization bath can be set at any value depending on the purposes, but in general ranges form 30 seconds to 5 minutes and it is in the range of 30 to 90 seconds for rapid processing. Further, the processing temperature is in general 20° to 40° C., but for rapid processing, it is set around 35° C. to promote washing.

In the present invention, the amount of replenisher for the water washing or stabilization bath ranges from 100 to 500 ml/m$^2$ for color paper and from 200 to 1200 ml/m$^2$ for color negative films. However, particularly excellent results can be obtained when it is adjusted to not more than 400 ml/m$^2$ for color paper and to not more than 800 ml/m$^2$ for color negative films.

The color light-sensitive materials to be processed according to the method of this invention will hereunder be explained in more detail.

The color light-sensitive materials to be processed in the present invention in general comprise a substrate provided thereon with a light-sensitive layer formed from a silver halide emulsion. Such silver halide emulsion comprises at least one member selected from the group consisting of silver chloride, silver bromide and silver iodide. For color paper, a silver halide emulsion preferably comprises silver chlorobromide substantially free of silver iodide. The term "substantially free of silver iodide" herein means that the content of silver iodide based on the total amount of silver halide is not more than 1 mole %, preferably not more than 0.3 mole %, more preferably not more than 0.1 mole % and most preferably absolutely zero.

The silver halide emulsions for color paper preferably used in the present invention are silver chlorobromide emulsions having a silver bromide content of not less than 10 mole %. Particularly to obtain an emulsion having sufficient sensitivity without increase in fog, the silver bromide content thereof is preferably not less than 20 mole %. In this respect, if it is desirable to perform a rapid processing in which the development time or the like is shortened, it is preferable to use silver chlorobromide having a silver bromide content of not more than 10 mole %, preferably not more than 3 mole %, and more preferably not more than 1 mole % (i.e., silver chloride emulsions substantially free of silver bromide).

As the silver bromide content of and emulsion decreases, the development speed is enhanced and simultaneously the concentration of bromide ions dissolved in a developer is also lowered when a light-sensitive material comprising such an emulsion is developed. Therefore, the developing capacity of the developer can be maintained through the supplementation of the minimum amount of the replenisher therefor.

For color negative films, emulsions comprising silver iodobromide or silver iodochlorobromide having a silver iodide content of not more than 30 mole % are generally used. Particularly, it is preferred to use silver iodobromide emulsion having a silver iodide content of 3 to 25 mole %, preferably 3 to 11 mole % and most preferably 3 to 8 mole %.

The grains of the silver halide photographic emulsion may be so-called regular grains such as cubic, octahedronic, tetradecahedronic or dodecahedronic, those having an irregular crystalline form such as spherical, and those having crystal defects such as twin face, or a composite form thereof.

The grains of silver halide may be fine grains of not more than about 0.1 micron or large-sized grains having a diameter of the projected area up to 10 microns. Moreover, the silver halide emulsion may be a monodisperse emulsion having a narrow grain size distribution or a polydisperse emulsion having a wide grain size distribution.

The silver halide photographic emulsion usable in the method of the invention can be prepared according to any known methods such as those disclosed in Research Disclosure No. 17643 (December, 1978), pp. 22–23, "I Emulsion preparation and types" and ibid, No. 18716 (November, 1979), p. 648.

The photographic emulsions as used herein may be prepared according to the methods such as those disclosed in P. Glafkides, Chimie et Physique Photographic, Paul Montel, 1967; G. F. Duffin, Photographic Emulsion Chemistry, Focal Press, 1966; and V. L. Zelikman et al., Making and Coating Photographic Emulsion, Focal Press, 1964.

In the present invention, it is preferred to use monodisperse photographic emulsions. Typical monodisperse emulsions comprise silver halide grains having an average grain size of not less than about 0.1 micron, win about 95% by weight having diameters of the average diameter +40%. In the present invention, an emulsion can be used which comprises silver halide grains having an average grain size of about 0.25 to 2 microns and in which about 95% by weight or 95% by number of silver halide grains have a diameter equal to the average diameter +20%.

In addition, tabular grains whose aspect ratio is at least about 5 can be used in the present invention. Such tabular grains may easily be prepared according to methods as disclosed in Gutoff, Photographic Science and Engineering, 1970, Vol. 14, pp. 248–257; U.S. Pat. Nos. 4,434,226; 4,414,310; 4,433,048 and 4,439,520; and U.K. Patent No. 2,112,157. The use of such tabular grains is preferred since the emulsion containing these grains is enhanced in its color sensitization efficiency due to a sensitizing dye, the graininess thereof is improved and the sharpness is increased. This is detailed in the above cited U.S. Pat. No. 4,434,226.

The crystalline structure of the silver halide grains may be uniform or different between the outer and the inner portions thereof.

The crystalline structure of the silver halide grains may be uniform or composed of those having different compositions between the inner and outer portions thereof. Typical examples of the latter are core-shell type or double-structured grains whose halogen composition in the inner portion differs from that in the surface layer thereof. In such a grain, the shape of the core may be the same as or different from that of the whole grain including core and shell.

More specifically, the core is cubic while the whole grain inclusive of the shell is cubic or octahedral or vice versa. In addition to those having a simple double structure, triple-structured or more higher structured ones and core-shell type double-structured ones whose surface is coated with a thin layer of silver halide having a different silver halide composition are also used in the invention.

In the light-sensitive materials processed by the method of the present invention, preferred silver halide emulsions used to form such light-sensitive layer comprise silver halide grains which do not have a uniform composition but have any structure with respect to the halogen composition. In silver chlorobromide emulsions for obtaining color paper, it is preferred to use silver halide grains whose silver bromide content is higher in the inner portion than in the surface region. Typical examples thereof include emulsions comprising core-shell type silver halide grains whose silver bromide content in the core portion is higher than that in the shell portion. The difference between the silver bromide content in the core and shell portions preferably ranges from 3 mole % to 95 mole % and the ratio (molar ratio) of the amount of silver in the core portion to that in the shell portion of 5:95 to 95:5, preferably 7:93 to 90:10.

Moreover, in silver iodobromide emulsions suitable for preparing color negative films, the core portion has a silver iodobromide content greater than that in the shell portion and the silver iodobromide content of the former ranges from 10 to 45 mole %, preferably 15 to 40 mole %. On the other hand, that of the shell portion is not more than 5 mole % and in particular not more than 2 mole %. In this case, the ratio (molar ratio) of the amount of silver in the core portion to that in the shell portion ranges from 15:85 to 85:15, preferably 15:85 to 75:25.

Such silver halide emulsions are disclosed in U.K. Patent No. 1,027,146; U.S. Pat. Nos. 3,505,068 and 4,444,877 and J.P.A. No 58-248469.

The silver halide photographic emulsion as used herein may be spectrally sensitized with a methine dye or the like. Examples of such dyes include cyanine dyes, merocyanine dyes, complex cyanine dyes, complex merocyanine dyes, horopolar cyanine dyes, hemicyanine dyes, styryl dyes and hemioxonol dyes. Particularly useful dyes are cyanine dyes, merocyanine dyes and complex merocyanine dyes.

As the sensitizing dyes used in the invention, there may be mentioned, for instance, those disclosed in Research Disclosure, Vol. 176, No. 17643, Item IV, p. 23 (December, 1978). The sensitizing dyes may be added to the photographic emulsions in any processes for preparing the emulsion or may be added to the emulsion at any time after the preparation thereof but prior to coating the same. Examples of the former are a process for forming silver halide grains, a physical ripening process or a chemical ripening process.

In particular, U.S. Pat. Nos. 4,183,756 and 4,225,666 disclose that spectral sensitizing dyes are added to and emulsion after the formation of stable nucleus for forming silver halide grains whereby the photographic sensitivity increases and the adsorption of the spectral sensitizing dyes on silver halide grains is remarkably enhanced.

The silver halide photographic emulsions used in the present invention may contain a variety of compounds for the purposes of preventing fogging during the manufacturing processes of light-sensitive materials, storing the same or photographic processing of these materials; or stabilizing the photographic properties of the processed materials. Examples of such additives include such azoles as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular 1l-phenyl-5-mercaptotetrazole); such thioketo compounds as oxazoline thione; such azaindenes as triazaindenes, tetrazaindenes (particularly 4-hydroxy substituted (1,3,3*n*,7)-tetrazaindenes) and pentazaindenes; and other various compounds known as antifoggants or stabilizers such as benzene thiosulfonic acid, benzene sulfonic acid and benzene sulfonic acid amide. These additives may be added to the emulsions alone or in combination. These additives are detailed in Research Disclosure (RD) Nos. 17643 and 18716. The relevant passages thereof are listed in the following Table.

| Kind of Additive | RD 17643 | RD 18716 |
|---|---|---|
| 1. Chemical sensitizer | p 23 | p 648, right column |
| 2. Sensitivity enhancing agent | | p 648, right column |
| 3. Spectral sensitizing agent, Supersensitizing agent | p 23–24 | p 648, right column to p 649, right column |
| 4. Whitener | p 24 | |
| 5. Antifoggant and stabilizer | p 24–25 | p 649, right column |
| 6. Light absorber, filter dye and ultraviolet absorber | p 25–26 | p 649, right column; p 650, left column |
| 7. Stain resistant agent | p 25, right column | p 650, left to right column |
| 8. Dye image stabilizer | p 25 | |
| 9. Film hardening agent | p 26 | p 651, left column |
| 10. Binder | p 26 | p 651, left column |
| 11. Plasticizer and lubricant | p 27 | p 650, right column |
| 12. Coating aid and surfactant | p 26–27 | p 650, right column |
| 13. Antistatic agent | p 27 | p 650, right column |

The color light-sensitive materials processed according to the present invention may contain various color couplers. Typical examples of such color couplers include cyan, magenta and yellow dye forming couplers disclosed in patents cited in Research Disclosure No. 17643, item VII-D (December, 1978) and ibid, No. 18717 (November, 1979). These color couplers are preferably made non-diffusible by imparting thereto ballast groups or polymerizing them to form dimers or higher polymers and these may be either 2- to 4-equivalent couplers. It is also possible to use couplers which can improve the graininess due to the diffusion of the resulting dye and DIR couplers which release development inhibitors during coupling reaction to thereby provide edge effect and interlayer effect.

In addition, the compounds disclosed in J.P. KOKAI Nos. 57-150845, 59-50439, 59-157638 and 59-170840 and J.P.A. No. 58-146097 can also be used. These compounds release groups having development accelerators to thereby improve the sensitivity or groups serving to fog silver halides, as the coupling reaction proceeds.

In order to achieve the effects of the present invention, it is preferable to use couplers having low 4-equivalent coupler content. More specifically, the content of the 4-equivalent couplers is preferably not more than 50 mole %, more preferably not more than 40 mole % and most preferably 30 mole % based on the total amount of couplers present in the color light-sensitive material.

Preferred examples of yellow couplers include 2-equivalent alpha-pivaloyl or alpha-benzoyl acetanilide type couplers which cause elimination at the oxygen or nitrogen atom. Particularly preferred examples thereof are oxygen atom elimination type yellow couplers as disclosed in U.S. Pat. Nos. 3,408,194; 3,447,928; 3,933,501 and 4,022,620 and nitrogen atom elimination type yellow couplers as disclosed in U.S. Pat. Nos. 3,973,968 and 4,314,023, J.P. KOKOKU No. 58-10739, J.P. KOKAI No. 50-132926, DEOS Nos. 2,219,917, 2,261,361, 2,329,587 and 2,433,812.

Examples of magenta couplers used in the invention include 5-pyrazolone type couplers, pyrazolo(5,1-c)(1,2,4)triazoles as disclosed in U.S. Pat. No. 3,725,067 and pyrazolo(5, 1l-b)(1,2,4)triazole as disclosed in European Patent No. 119,860. It is also preferred to use magenta couplers dimerized with and elimination group which is bonded thereto through nitrogen or oxygen atom at the coupling active positions.

As cyan couplers, those resistant to humidity and heat are preferably used in the invention. Typical examples thereof include phenol type couplers as disclosed in U.S. Pat. No. 3,772,002; 2,5-diacylaminophenol type couplers such as those disclosed in J.P. KOKAI Nos. 59-31953 and 58-133293 and J.P.A. No. 58-42671; phenol type couplers which have a phenylureido group at 2-position and an acylamino group at 5-position of the phenol nucleus, such as those disclosed in U.S. Pat. No. 4,333,999; and naphthol type couplers as disclosed in J.P.A. No. 59-93605.

To make the correction for the unnecessary minor absorptions which exist at the short wave length side of the principal absorption of the formed dye, colored couplers colored with yellow or magenta color may be used simultaneously. These couplers are in general used in the form of an emulsion prepared by dispersing them in an aqueous medium while simultaneously utilizing high boiling point organic solvents such as phthalic acid esters ordinarily having 16 to 32 carbon atoms or phosphate esters and optionally other organic solvents such as ethyl acetate. The standard amount of the couplers used preferably ranges from 0.01 to 0.5 moles for the yellow couplers; 0.003 to 0.3 moles for the magenta couplers and 0.002 to 0.3 moles for the cyan couplers, per mole of light-sensitive silver halide.

The principal object of the present invention is to prevent the sensitizing dye dissolved out mainly from color negative films from dyeing the color paper. The method of the present invention is effective for any kinds of sensitizing dyes. However, it is preferable to process the light-sensitive materials comprising the following sensitizing dyes:

(a) Sensitixing Dye (IIa)

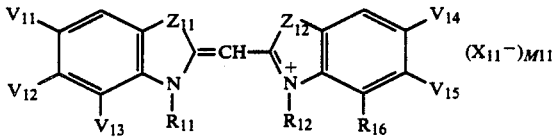

In the formula, $Z_{11}$ represents oxygen, sulfur or selenium atom and $Z_{12}$ represents sulfur or selenium atom.

$R_{11}$ and $R_{12}$ each represents a substituted or unsubstituted alkyl or alkenyl group having not more than 6 carbon atoms, either of these presents a sulfo-substituted alkyl group and at least one of these most preferably represents 3-sulfopropyl, 2-hydroxy-3-sulfopropyl, 3-sulfobutyl or sulfoethyl group. Examples of the substituents for these groups include halogen aroms, a hydroxyl group, a carbamoyl group, a carboxyl group, a sulfo group, alkoxy groups having not more than 4 carbon atoms, alkoxycarbonyl groups having not more than 5 carbon atoms or optionally substituted phenyl groups having not more than 8 carbon atoms. Specific examples of $R_{11}$ and $R_{12}$ are methyl, ethyl, propyl, allyl, pentyl, hexyl, methoxyethyl, ethoxyethyl, phenethyl, 2-p-tolylethyl, 2-p-sulfophenethyl, 2,2,2l-trifluoroethyl, 2,2,3,3-tetrafluoropropyl, carbamoylethyl, hydroxyethyl, 2-(2-hydroxyethyl)-ethyl, carboxymethyl, carboxythyl, ethoxycarbonylmethyl, 2-sulfoethyl, 2-chloro-3-sulfopropyl, 3-sulfopropyl, 2-hydroxy-3-sulfopropyl, 3-sulfobutyl and 4-sulfobutyl groups.

If $Z_{11}$ is an oxygen atom, $V_{11}$ and $V_{13}$ each represents a hydrogen atom, $V_{12}$ is a phenyl group, an alkyl or alkoxy group having at most 3 carbon atoms, or a phenyl group substituted by chlorine atoms (particularly preferred $V_{12}$ is a phenyl group), provided that $V_{11}$ and $V_{12}$ or $V_{12}$ and $V_{13}$ may be bonded together to form a condensed benzene ring. The most preferred sensitizing dye (IIa) is one in which $V_{11}$ and $V_{13}$ represent hydrogen atoms and $V_{12}$ represents a phenyl group.

If $Z_{11}$ is a sulfur or selenium atom, $V_{11}$ represents a hydrogen atom or and alkyl or alkoxy group having at most 4 carbon atoms, $V_{12}$ represents an alkyl group having not more than 5 carbon atoms, an alkoxy group having not more than 4 carbon atoms, a chlorine or hydrogen atom, optionally substituted phenyl group such as tolyl, anisyl or phenyl group or a hydroxyl group, and $V_{13}$ is a hydrogen atom, provided that $V_{11}$ and $V_{12}$ or $V_{12}$ and $V_{13}$ may be bonded together to form a condensed benzene ring. More preferred examples of sensitizing dyes (IIa) are those in which $V_{11}$ and $V_{13}$ are hydrogen atoms and $V_{12}$ is an alkoxy group having not more than 4 carbon atoms, a phenyl group or a chlorine atom; those in which $V_{11}$ is an alkoxy or alkyl group having at most 4 carbon atoms and $V_{12}$ is a hydroxyl group or an alkyl group having at most 4 carbon atoms; or those in which $V_{12}$ and $V_{13}$ are bonded together to form a condensed benzene ring.

If $Z_{12}$ is a selenium atom, $V_{14}$, $V_{15}$ and $V_{16}$ each has the same definition as $V_{11}$, $V_{12}$ or $V_{13}$ defined above with respect to the case where $Z_{11}$ is a selenium atom.

If $Z_{12}$ is a sulfur atom and $Z_{11}$ is a selenium atom, $V_{14}$ is a hydrogen atom, an alkoxy group having not more than 4 carbon atoms or an alkyl group having not more than 5 carbon atoms, $V_{15}$ is an alkoxy group having not more than 4 carbon atoms, an optionally substituted phenyl group such as a phenyl, tolyl or anisyl group (preferably a phenyl group), an alkyl group having not more than 4 carbon atoms, a chlorine atom or a hydroxyl group and $V_{16}$ is a hydrogen atom, provided that $V_{14}$ and $V_{15}$ or $V_{15}$ and $V_{16}$ are bonded together to form a condensed benzene ring. In more preferred sensitizing dyes, $V_{14}$ and $V_{16}$ are hydrogen atoms and $V_{15}$ is an alkoxy group having not more than 4 carbon atoms, a chlorine atom or a phenyl group or $V_{15}$ and $V_{16}$ are bonded together to form a condensed benzene ring.

If both $Z_{11}$ and $Z_{12}$ represent a sulfur atom, $V_{14}$ and $V_{16}$ are hydrogen atoms and $V_{15}$ is an optionally substituted phenyl group such as a phenyl or tolyl group; or $V_{14}$ is a hydrogen atom and $V_{15}$ and $V_{16}$ are bonded together to form a condensed benzene ring. If $Z_{11}$ is an oxygen atom and $Z_{12}$ is a sulfur atom, $V_{14}$ and $V_{16}$ are hydrogen atoms and $V_{15}$ a chlorine atom, an optionally substituted phenyl group or an alkoxy group having not more than 4 carbon atoms or $V_{15}$ and $V_{16}$ are bonded together to form a condensed benzene ring. More preferably, $V_{14}$ and $V_{16}$ are hydrogen atoms and $V_{15}$ is a phenyl group; or $V_{15}$ and $V_{16}$ are bonded together to form a condensed benzene ring.

$X_{11}$ represents an anionic acid residue.

$m_{11}$ is an integer of 0 or 1 provided that it is 1 when the compound is in the form of an intramolecular salt.

(b) Sensitizing Dye (IIb)

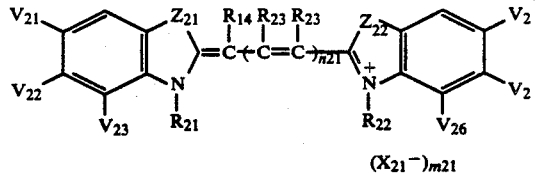

In the formula, $Z_{21}$ and $Z_{22}$ may be the same or different and each represents an oxygen, sulfur or selenium atom or group N—$R_{26}$.

$R_{21}$ and $R_{22}$ have the same meanings as those defined in connection with $R_{11}$ and $R_{12}$ respectively and further $R_{21}$ and $R_{24}$; or $R_{22}$ and $R_{25}$ may be bonded together to form a 5- or 6-membered carbon ring. Moreover, if $n_{21}$ represents 2 or 3, both $R_{21}$ and $R_{22}$ do not simultaneously represent a substituent having sulfo groups.

$R_{23}$ represents a hydrogen atom if at least one of $Z_{21}$ and $Z_{22}$ represents N—$R_{26}$ and otherwise represents a lower alkyl group or a phenethyl group (more preferably an ethyl group). Further, different two groups $R_{23}$ may be bonded together to form a 5- or 6-membered ring, if $n_{21}$ is 2 or 3.

$R_{24}$ and $R_{25}$ each represents a hydrogen atom or a single bond.

$R_{26}$ and $R_{27}$ have the same meanings as $R_{21}$ and $R_{22}$ respectively provided that $R_{21}$ and $R_{26}$ never represent a substituent having sulfo groups simultaneously and the same apply to $R_{22}$ and $R_{27}$.

$V_{21}$ represents a hydrogen atom if $Z_{21}$ is an oxygen atom; a hydrogen atom, or an alkyl or alkoxy group having not more than 5 carbon atoms if $Z_{21}$ is a sulfur or selenium atom; or a hydrogen or chlorine atom of $Z_{21}$ is a group N—$R_{26}$.

$V_{22}$ represents a hydrogen or chlorine atom, an alkyl or alkoxy group having not more than 5 carbon atoms or an optionally substituted phenyl group (for instance, a tolyl, anisyl or phenyl group) or it may be bonded together with $V_{21}$ or $V_{23}$ to form a condensed benzene ring (more preferably, $V_{22}$ represents an alkoxy or phenyl group; or $V_{21}$ and $V_{22}$, or $V_{22}$ and $V_{23}$ are bonded together to form a condensed benzene ring) if $Z_{21}$ is an oxygen atom and $Z_{22}$ is a group N—$R_{26}$; it represents an optionally substituted phenyl group (for instance, a tolyl, anisyl or phenyl group, in particular a phenyl group) or may be bonded together with $V_{21}$ or $V_{23}$ to form a condensed benzene ring if $Z_{21}$ and $Z_{22}$ principally represent oxygen atoms; or it represents a hydrogen or chlorine atom, an alkyl or alkoxycarbonyl group having not more than 5 carbon atoms, an alkoxy or acylamino group having not more than 4 carbon atoms, or an optionally substituted phenyl group (more preferably an alkyl or alkoxy group having not more than 4 carbon atoms, a chlorine atom or a phenyl group) or may be bonded together with $V_{23}$ to form a condensed benzene ring, if $Z_{21}$ represents a sulfur or selenium atom; or it represents a chlorine atom, a trifluoromethyl group, a cyano group, an alkylsulfonyl group having not more than 4 carbon atoms or an alkoxycarbonyl group having not more than 5 carbon atoms if $Z_{21}$ is a group N—$R_{26}$. If $Z_{21}$ is a group N—$R_{26}$, more preferably $V_{21}$ represents a chlorine atom and $V_{22}$ represents a chlorine atom, a trifluoromethyl group or a cyano group.

$V_{24}$ is the same as defined above in connection with $V_{21}$ when $Z_{22}$ represents each atomic species corresponding to $Z_{21}$.

$V_{25}$ represents a chlorine atom, an alkoxy group having not more than 4 carbon atoms or an optionally substituted phenyl group (for instance, a tolyl, anisyl or phenyl group) or may form a condensed benzene ring together with $V_{24}$ or $V_{26}$ if $Z_{22}$ is an oxygen atom, more preferably it represents an alkoxy group having not more than 4 carbon atoms or a phenyl group or may form a condensed benzene ring together with $V_{24}$ or $V_{26}$ and $Z_{21}$ represents a group N—$R_{26}$; more preferred $V_{25}$ is a phenyl group or may form a condensed benzene ring together with $V_{24}$ or $V_{26}$ if $Z_{21}$ is an oxygen, sulfur or selenium atom. When $Z_{22}$ is a group N—$R_{26}$, $V_{25}$ is the same as defined above in connection with $V_{22}$ provided with $Z_{21}$ is a group N—$R_{26}$ and when $Z_{22}$ is a sulfur or selenium atom, $V_{25}$ is the same as defined above in connection with $V_{22}$ provided with $Z_{21}$ is a sulfur or selenium atom.

$V_{26}$ represents a hydrogen atom or a single bond.

$X_{21}$ is an anionic acid residue.

$m_{21}$ is an integer of 0 or 1 provided that it is 0 if the compound is in the form of an intramolecular salt.

$n_{21}$ is an integer of 1,2 or 3.

As discussed above in detail, the method of the present invention makes it possible to simultaneously process color light-sensitive materials for taking photographs such as color negative films and color light-sensitive materials for prints such as color paper in the same processing bath at least in the bleach-fixing, water washing and/or stabilization processes. As a result, the color light-sensitive materials for taking photographs and the print color light-sensitive materials for print which differ in the silver iodide content from one another can be processed in one automatic developing machine and, therefore, the space for installing the same can substantially be reduced.

Further as these materials can be processed, in each processing bath, using only one common processing solution, this leads to the reduction of the number of processing solutions to be prepared and if the method is combined with the replenisher-saving processing, the amount of waste is greatly reduced and the operations can also be simplified substantially.

The present invention is not limited to the processing of color paper and color negative films, but is applied to the processing of various kinds of light-sensitive materials such as the combination of color reversal films and color reversal paper; and color autopositive paper and color autopositive films. It should be appreciated that the combination of the light-sensitive materials be not restricted to these specific examples.

The present invention will hereunder be explained in more detail with reference to the following non-limitative working examples and the effects of the present invention practically achieved will also be discussed in detail below comparing with those observed in Comparative Examples.

EXAMPLE 1

A sample of multilayered color light-sensitive material having the following layer structure was prepared by applying coating solutions whose composition was detailed below to the surface of a cellulose triacetate substrate to which an underlying coating had been applied.

The amounts coated are expressed in the reduced amount of silver (g/m²l) for silver halides and colloidal silvers; g/m² for couplers, additives and gelatin; and molar amount per mole of silver halide included in the same layer for sensitizing dyes.

| (Composition of Each Coating Solution) | |
|---|---|
| 1st Layer: Halation Inhibiting Layer | |
| Black colloidal silver | 0.2 |
| Gelatin | 1.3 |
| Coupler C-1 | 0.06 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| 2nd layer: Intermediate Layer | |
| Silver bromide of fine grain (average grain size = 0.07 microns) | 0.15 |
| Gelatin | 1.0 |
| Coupler C-2 | 0.02 |

-continued

| (Composition of Each Coating Solution) | |
|---|---|
| Dispersion oil Oil-1 | 0.1 |
| 3rd Layer: First Red-sensitive Emulsion Layer | |
| Silver iodobromide emulsion (AgI content = 2 mole %; diameter/thickness ratio = 2.5; average grain size = 0.3 microns; AgI content is high at the internal portion) | 0.4 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |
| 4th Layer: Second Red-sensitive Emulsion Layer | |
| Silver iodobromide emulsion (AgI content = 5 mole %; diameter/thickness ratio = 4.0; average grain size = 0.7 microns; AgI content is high at the internal portion) | 0.7 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |
| 5th Layer: Third Red-sensitive Emulsion Layer | |
| Silver iodobromide emulsion (AgI content = 10 mole %; diameter/thickness ratio = 1.3; average grain size = 0.8 microns; AgI content is high at the internal portion) | 1.0 (Ag) |
| Gelatin | 1.0 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-6 | 0.05 |
| Coupler C-7 | 0.1 |
| Dispersion oil Oil-1 | 0.01 |
| Dispersion oil Oil-2 | 0.05 |
| 6th Layer: Intermediate Layer | |
| Gelatin | 1.0 |
| Compound Cpd-A | 0.03 |
| Dispersion oil Oil-1 | 0.05 |
| 7th Layer: First Green-sensitive Emulsion Layer | |
| Silver iodobromide emulsion (AgI content = 2 mole %; diameter/thickness ratio = 2.5; average grain size = 0.3 microns; AgI content is high at the internal portion) | 0.3 (Ag) |
| Gelatin | 1.0 |
| Sensitizing dye IV | $5 \times 10^{-4}$ |
| Sensitizing dye VI | $0.3 \times 10^{-4}$ |
| Sensitizing dye V | $2 \times 10^{-4}$ |
| Coupler C-9 | 0.2 |
| Coupler C-5 | 0.03 |
| Coupler C-1 | 0.03 |
| Compound Cpd-C | 0.012 |
| Dispersion oil Oil-1 | 0.5 |
| 8th Layer: Second Green-sensitive Emulsion Layer | |
| Silver iodobromide emulsion (AgI content = 4 mole %; diameter/thickness ratio = 4.0; average grain size = 0.6 microns; AgI content is high at the internal portion) | 0.4 (Ag) |
| Gelatin | 1.0 |
| Sensitizing dye IV | $5 \times 10^{-4}$ |

-continued

| (Composition of Each Coating Solution) | |
|---|---|
| Sensitizing dye VI | $0.3 \times 10^{-4}$ |
| Sensitizing dye V | $2 \times 10^{-4}$ |
| Coupler C-9 | 0.25 |
| Coupler C-1 | 0.03 |
| Coupler C-10 | 0.015 |
| Coupler C-5 | 0.01 |
| Compound Cpd-C | 0.012 |
| Dispersion oil Oil-1 | 0.2 |
| 9th Layer: Third Green-sensitive Emulsion Layer | |
| Silver iodobromide emulsion (AgI content = 6 mole %; diameter/thickness ratio = 1.2; average grain size = 1.0 microns; AgI content is high at the internal portion) | 0.85 (Ag) |
| Gelatin | 1.0 |
| Sensitizing dye VII | $3.5 \times 10^{-4}$ |
| Sensitizing dye VIII | $1.4 \times 10^{-4}$ |
| Coupler C-13 | 0.01 |
| Coupler C-12 | 0.03 |
| Coupler C-9 | 0.20 |
| Coupler C-1 | 0.02 |
| Coupler C-15 | 0.02 |
| Dispersion oil Oil-1 | 0.20 |
| Dispersion oil Oil-2 | 0.05 |
| 10th Layer: Yellow Filter Layer | |
| Gelatin | 1.2 |
| Yellow colloidal silver | 0.08 |
| Compound Cpd-B | 0.1 |
| Dispersion oil Oil-1 | 0.3 |
| 11th Layer: First Blue-sensitive Emulsion Layer | |
| Silver iodobromide emulsion (AgI content = 4 mole %; diameter/thickness ratio = 1.5; average grain size = 0.5 microns; AgI content is high at the internal portion) | 0.4 (Ag) |
| Gelatin | 1.0 |
| Sensitizing dye IX | $2 \times 10^{-4}$ |
| Coupler C-14 | 0.9 |
| Coupler C-5 | 0.07 |
| Dispersion oil Oil-1 | 0.2 |
| 12th Layer: Second Blue-sensitive Emulsion Layer | |
| Silver iodobromide emulsion (AgI content = 10 mole %; diameter/thickness ratio = 4.5; average grain size = 1.3 microns; AgI content is high at the internal portion) | 0.4 (Ag) |
| Gelatin | 0.6 |
| Sensitizing dye IX | $1 \times 10^{-4}$ |
| Coupler C-14 | 0.25 |
| Dispersion oil Oil-1 | 0.07 |
| 13th Layer: First Protective Layer | |
| Gelatin | 0.8 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| 14th Layer: Second Protective Layer | |
| Fine grain silver bromide (average grain size = 0.07 micron) | 0.5 |
| Gelatin | 0.45 |
| Polymethylmethacrylate particles (diameter = 1.5 micron) | 0.2 |
| Film hardening agent H-1 | 0.4 |
| n-Butyl p-hydroxybenzoate | 0.012 |
| Formaldehyde scavenger S-1 | 0.5 |
| Formaldehyde scavenger S-2 | 0.5 |

In each layer, a surfactant was added to the coating solution as a coating aid in addition to the foregoing components.

The chemical structural formulas or chemical names of the compound used in this Example are as follows:

UV-1

-continued
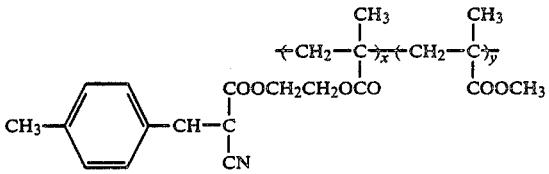
z/y = 7/3 (weight ratio)
UV-2
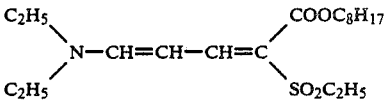
Oil-1: Tricresyl phosphate
Oil-2: Dibutyl phtharate
Oil-3: Bis(2-ethylhexyl) phtharate
C-1
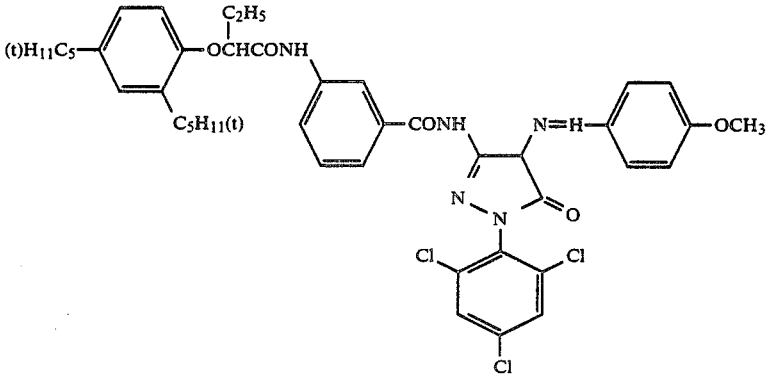
C-2
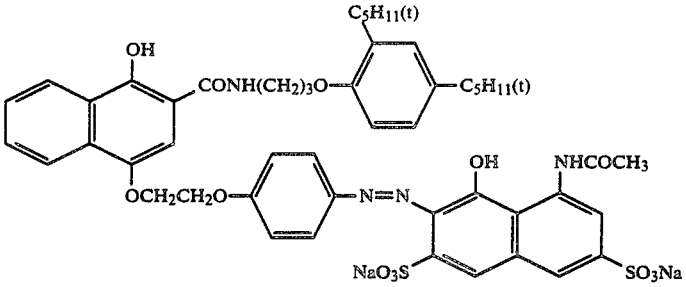
C-3
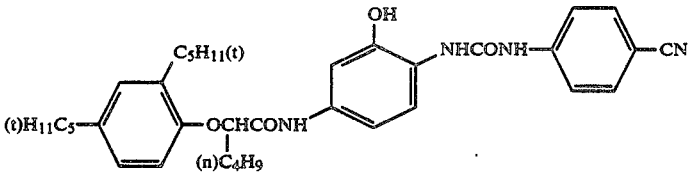
C-4
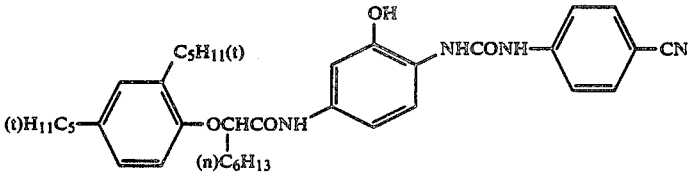
C-5

-continued
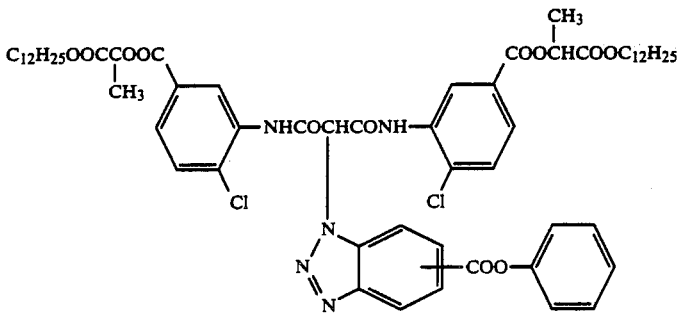
C-6
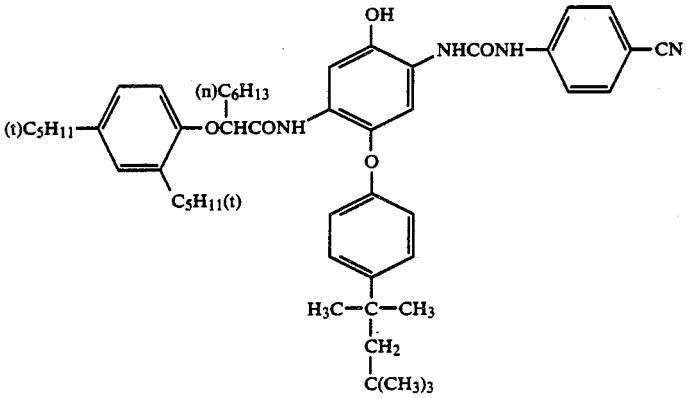
C-7
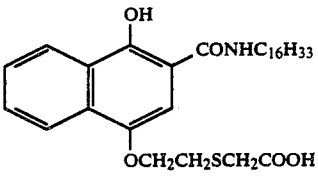
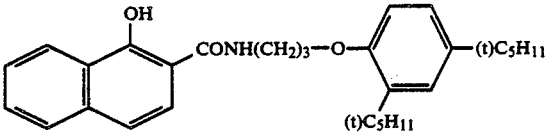
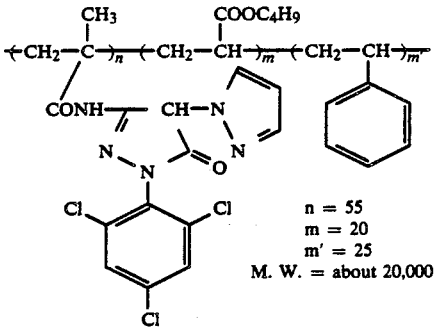
C-10

-continued
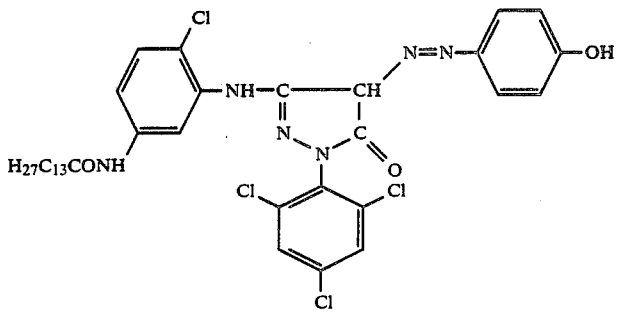
C-11
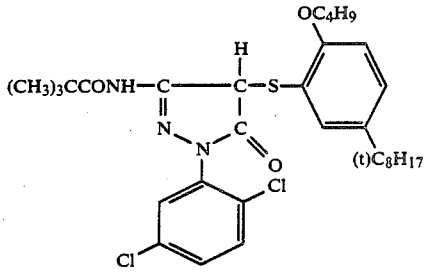
C-12
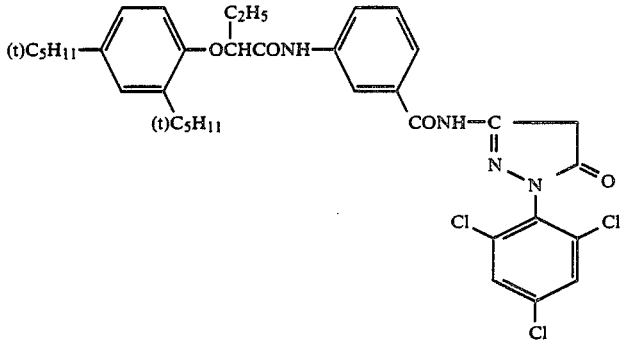
C-13
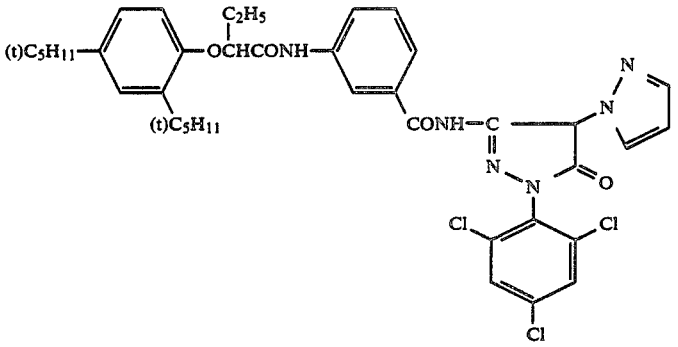
C-14
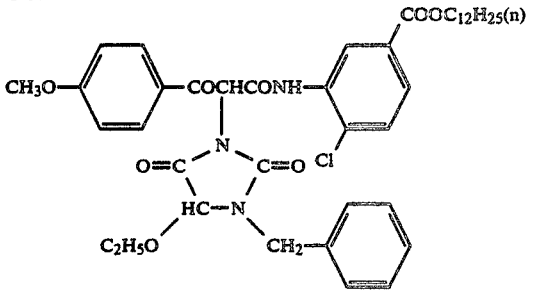

-continued
C-15
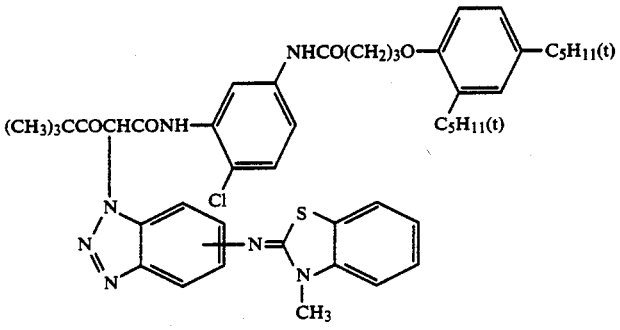
Cpd-A
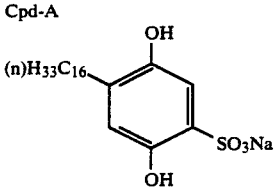
Cpd-B
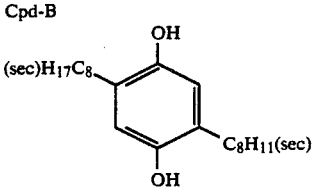
Cpd-C
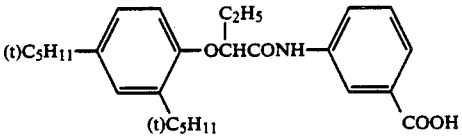
Sensitizing Dye I
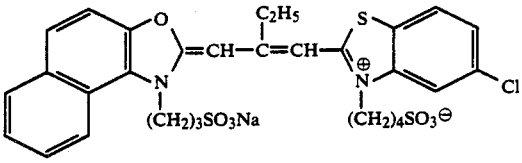
Sensitizing Dye II
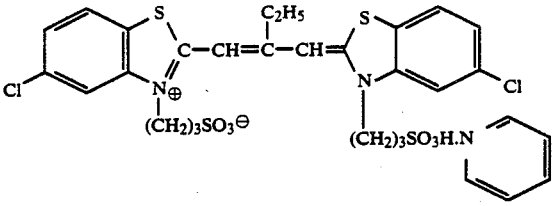
Sensitizing Dye III
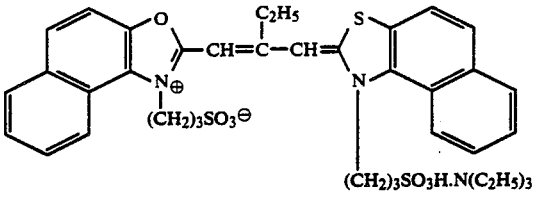
Sensitizing Dye IV
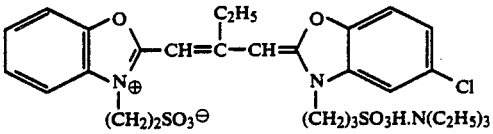
Sensitizing Dye V -continued

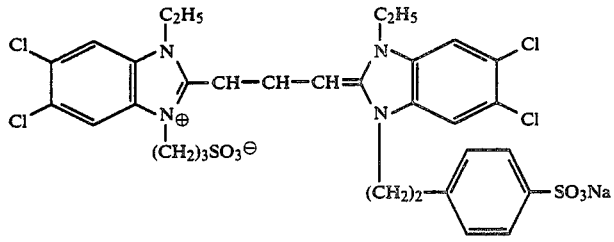

Sensitizing Dye VI

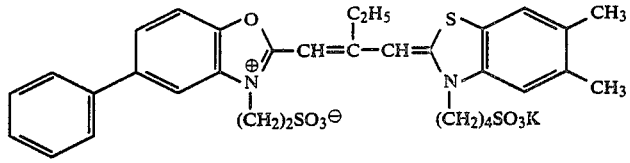

Sensitizing Dye VII

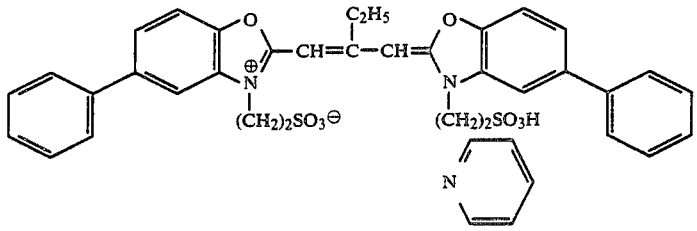

Sensitizing Dye VIII

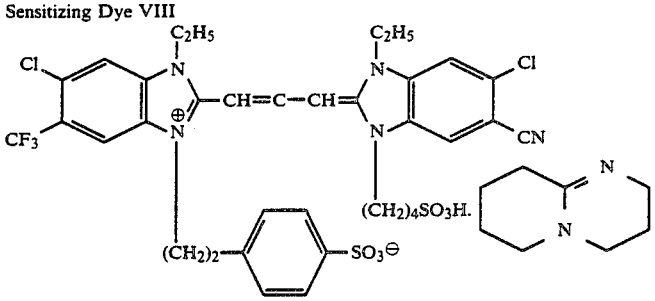

Sensitizing Dye IX

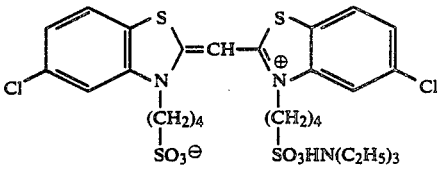

H-1

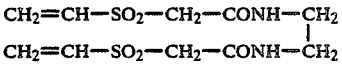

S-1 S-2

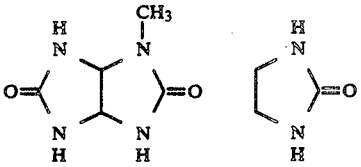

On the other hand, color paper for prints having the following layer structure was prepared by applying coating solutions to the surface of a paper substrate of which both sides had been laminated with polyethylene films. The coating solutions were prepared as follows:

Preparation of the Coating Solution for 1st Layer

To yellow couplers ExY-1 and ExY-2 (10.2 g and 9.1 g respectively) and 4.4 g of a dye image stabilizer (Cpd-1) were added 27.2 cc of ethyl acetate and 7.7 cc (8.0 g)

of a high boiling point solvent (Solv-1) to dissolve them and the resulting solution was dispersed in 185 cc of 10% aqueous gelatin solution containing 8 cc of 10% sodium dodecylbenzene sulfonate to form an emulsion. This emulsion was mixed with and dispersed in emulsions EM 1 and EM 2 and the concentration of gelatin was adjusted to be consistent with the following composition to obtain the coating solution for a 1st layer. The coating solutions for 2nd to 7th layers were also prepared in the same manner. To each layer, sodium salt of 1-oxy-3, 5-dichloro-s-triazine was added as a gelatin hardening agent. Moreover, Cpd-2 was used as a thickener.

Layer Structure

The composition of each layer is given below. Numerical values represent coated amounts expressed in g/m$^2$. The amount of silver halide emulsion is expressed in the amount of elemental silver.

Substrate: Paper laminated with polyethylene films (the polyethylene film on the side of the 1st layer includes a white pigment ($TiO_2$) and a blueing dye).

| | |
|---|---|
| 1st Layer: Blue sensitive Emulsion Layer | |
| Monodisperse silver chlorobromide emulsion spectrally sensitized with sensitizing dye ExS-1 (EM-1) | 0.13 |
| Monodisperse silver chlorobromide emulsion spectrally sensitized with sensitizing dye ExS-1 (EM-2) | 0.13 |
| Gelatin | 1.86 |
| Yellow coupler Exy-1 | 0.44 |
| Yellow coupler ExY-2 | 0.39 |
| Color image stabilizer Cpd-1 | 0.19 |
| Solvent solv-1 | 0.35 |
| 2nd Layer: Color Mixing inhibiting Layer | |
| Gelatin | 0.99 |
| Color mixing inhibitor Cpd-3 | 0.88 |
| 3rd Layer: Green-sensitive Emulsion Layer | |
| Monodisperse silver chlorobromide emulsion spectrally sensitized with sensitizing dye ExS-2,3 (EM-3) | 0.05 |
| Monodisperse silver chlorobromide emulsion spectrally sensitized with sensitizing dye ExS-2,3 (EM-4) | 0.11 |
| Gelatin | 1.80 |
| Magenta coupler ExM-1 | 0.39 |
| Color image stabilizer Cpd-4 | 0.20 |
| Color image stabilizer Cpd-5 | 0.02 |
| Color image stabilizer Cpd-6 | 0.03 |
| Solvent Solv-2 | 0.12 |
| Solvent Solv-3 | 0.25 |
| 4th Layer: Ultraviolet Absorbing Layer | |

-continued

| | |
|---|---|
| Gelatin | 1.60 |
| Ultraviolet absorber (Cpd-7/Cpd-8/Cpd-9 = 3/2/6; weight ratio) | 0.07 |
| Color mixing inhibitor Cpd-10 | 0.05 |
| Solvent Solv-4 | 0.27 |
| 5th Layer: Red-sensitive Emulsion Layer | |
| Monodisperse silver chlorobromide emulsion spectrally sensitized with sensitizing dye ExS-4,5 (EM-5) | 0.07 |
| Monodisperse silver chlorobromide emulsion spectrally sensitized with sensitizing dye ExS-4,5 (EM-6) | 0.16 |
| Gelatin | 0.92 |
| Cyan coupler ExC-1 | 0.32 |
| Color image stabilizer (Cpd-8/Cpd-9/Cpd-12 = 1/5/3; weight ratio) | 0.17 |
| Polymer for dispersion Cpd-11 | 0.28 |
| Solvent solv-2 | 0.20 |
| 6th Layer: Ultraviolet Absorbing Layer | |
| Gelatin | 0.54 |
| Ultraviolet absorber (Cpd-7/Cpd-9/Cpd-12 = 1/5/3; weight ratio) | 0.21 |
| Solvent solv-2 | 0.08 |
| 7th Layer: Protective Layer | |
| Gelatin | 1.33 |
| Acryl modified copolymer of polyvinyl alcohol (degree of modification = 17%) | 0.17 |
| Liquid paraffin | 0.03 |

In this case, Cpd-13 and Cpd-145 were used as irradiation inhibiting dyes.

In addition to the foregoing components, each layer contained Alkanol XC (available from DuPont Co., ltd.) sodium alkylbenzenesulfonate, succiante and Megafac F-120 1 (available from DAINIPPON INK AND CHEMICALS, INC.) as an emulsifying and dispersing agent and a coating aid. Moreover, Cpd-15 and Cpd-16 were used as stabilizers for silver halide.

The details of the emulsions used in this Example are as follows:

| Emulsion | Grain Size (micron) | Br Content (mole %) | Coefficient of Variation |
|---|---|---|---|
| EM-1 | 1.0 | 80 | 0.08 |
| EM-2 | 0.75 | 80 | 0.07 |
| EM-3 | 0.5 | 83 | 0.09 |
| EM-4 | 0.4 | 83 | 0.10 |
| EM-5 | 0.5 | 73 | 0.09 |
| EM-6 | 0.4 | 73 | 0.10 |

The structural formulas of the compounds used in this Example are as follows:

ExY-1

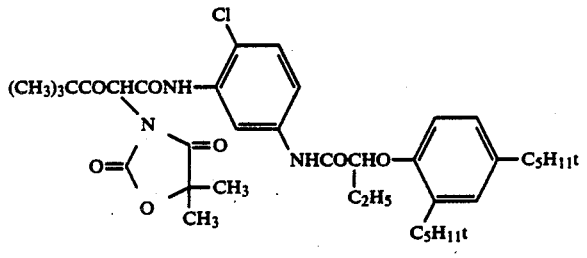

-continued
ExY-2
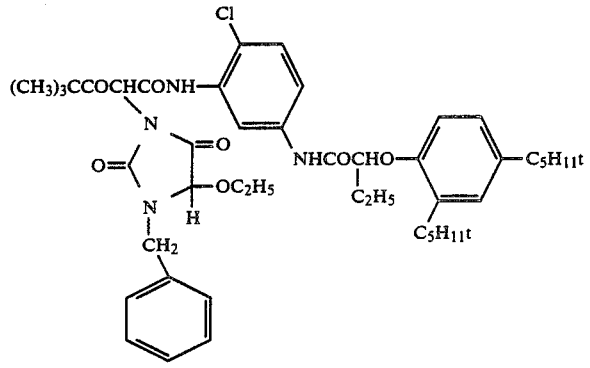
ExM-1
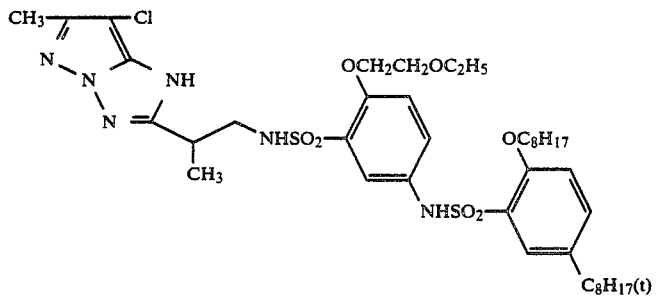
ExC-1
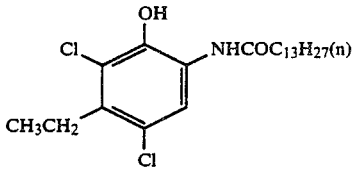
ExS-1
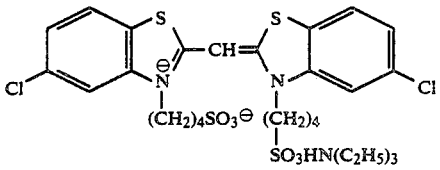
ExS-2
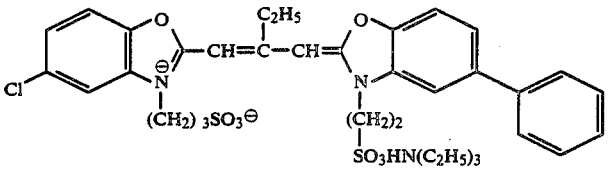
ExS-3
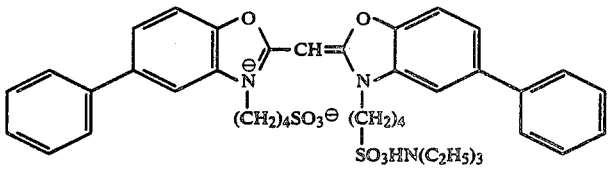
ExS-4
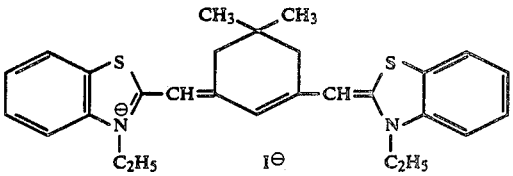

-continued
ExS-5
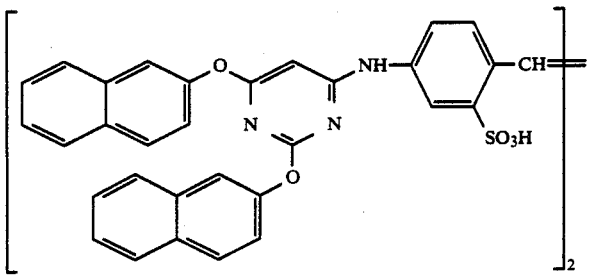
Cpd-1
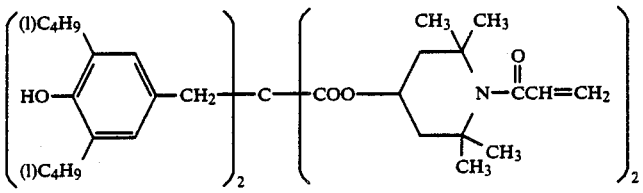
Cpd-2
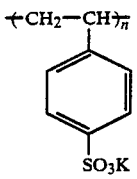
Cpd-3
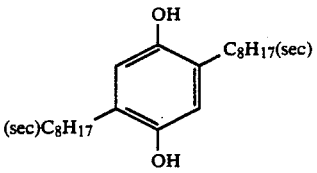
Cpd-4
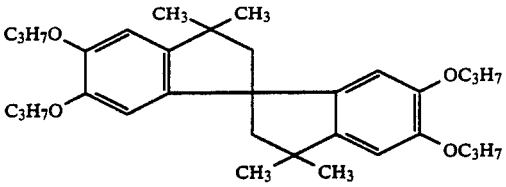
Cpd-5
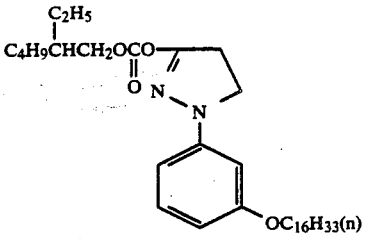
Cpd-6
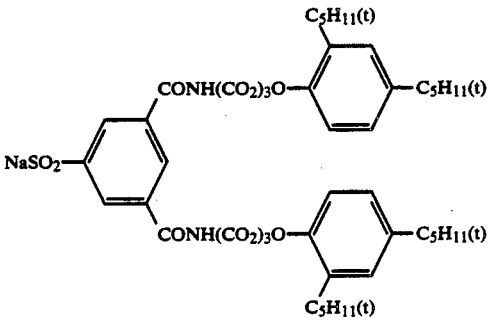

-continued
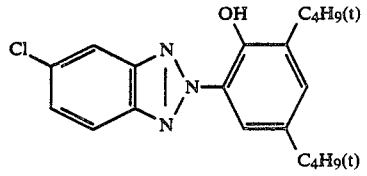
Cpd-7
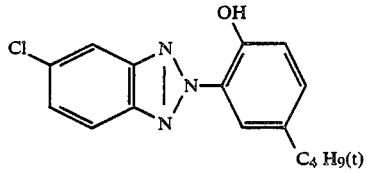
Cpd-8
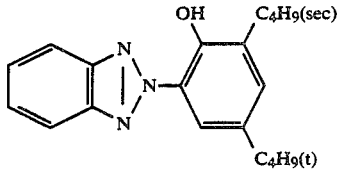
Cpd-9
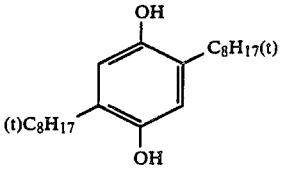
Cpd-10
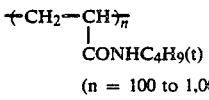
(n = 100 to 1,000)
Cpd-11
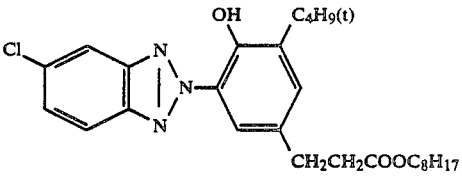
Cpd-12
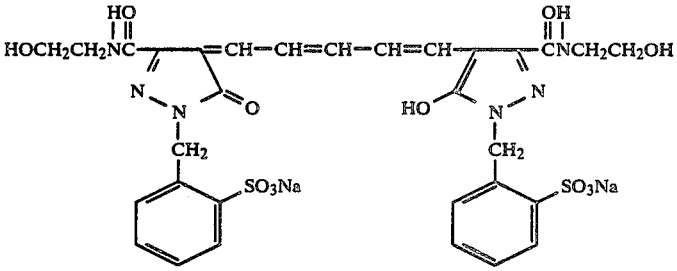
Cpd-13
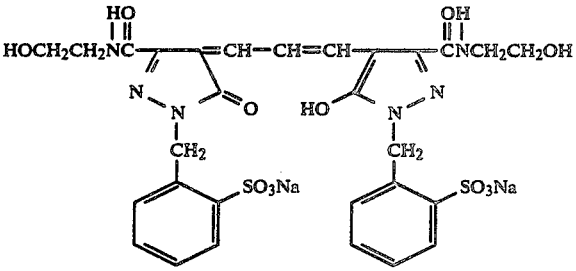
Cpd-14

-continued

Cpd-15

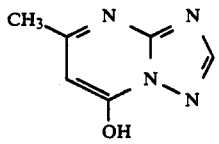

Cpd-16

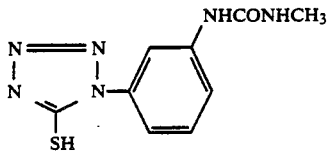

Solv-1: Dibutyl phtharate
Solv-2: Tricresyl phosphate
Solv-3: Trioctyl phosphate
Solv-4: Trinonyl phosphate The color negative film thus produced was cut into band like pieces 35 mm wide and the color paper was also cut into band like pieces 82.5 mm wide.

These color negative film and color paper were simultaneously processed in the following manner using an automatic developing machine as shown in FIG. 1 while supplementing a replenisher, the machine being designed so that they could simultaneously be processed in processing baths other the color development bath. The details of the processing are as follows:

TABLE I

| Process | Temp. (°C.) | Processing Steps: Processing time (sec) C.N.f. | C.P. | Amount Replenished* C.N.F.(ml) | C.P.(ml) |
|---|---|---|---|---|---|
| Color development | 38 | 195 | 100 | 600 | 290 |
| Bleach-fixing | 35 | 195 | 60 | 670 | 180 |
| Water washing (1) | 35 | 20 | 20 | | |
| Water washing (2) | 35 | 20 | 20 | 800** | 360** |
| Water washing (3) | 35 | 20 | 20 | | |
| Drying | 55/70*** | 60 | 50 | | |

*The amount replenished is expressed in the amount per 1 $m^2$ of the processed light-sensitive material.
**The water washing was carried out by 3-tank countercurrent system from (3) to (1).
***The upper numeral means the processing temperature for the color negative film (C.N.F) and the lower numeral means that for the color paper (C.P.).

In this connection, FIG. 1 shows the bath-arrangement in the automatic developing machine for the simultaneous processing (plan view). In this figure, the reference numeral 1*a* means a color development bath for color negative film (4 liters volume), 1*b* a color development bath for color paper (6 liters volume), 2 a bath for bleach-fixing (10 liters volume), 3 a water washing bath (1) (5 liters volume), 4 a water washing bath (2) (5 liters volume), 5 a water washing bath (3l) (5 liters volume), 6 a drying zone, 7 an inlet for color negative film, 8 an inlet for the color paper, 9 a recovery zone for color negative film and 10 a recovery zone for color paper, In addition, the shadowed portion A corresponds to a zone for converying color negative film and the shadowed portion B a zone for conveying color paper.

The composition of each processing solution used in each process are as follows:

| Component | Tank Solution | Replenisher |
|---|---|---|
| (Color Developing Solution for Color Paper) | | |
| Water | 800 ml | 800 ml |
| 60% Solution of 1-hydroxyethylidene-1,1-diphosphonic acid | 1.5 ml | 1.5 ml |
| Diethylenetriaminepentaacetic acid | 1.0 g | 1.0 g |
| Benzyl alcohol | 16 ml | 20 ml |
| Diethylene glycol | 10 ml | 10 ml |
| Sodium silfite | 2.0 g | 2.5 g |
| Hydroxylamine sulfate | 3.0 g | 3.5 g |
| Potassium bromide | 1.0 g | — |
| Sodium carbonate | 30 g | 35 g |
| Disodium 4,5-dihydroxy-m-benzene-disulfonate | 1.0 g | 1.1 g |
| Fluorescent whitener (stilbene type) | 1.0 g | 1.5 g |
| N-Ethyl-N-(beta-methanesulfonamido-ethyl)-3-methy-4-aminoaniline sulfate | 6.0 g | 8.0 g |
| Water | ad. 1000 ml | ad. 1000 ml |
| pH | 10.25 | 10.60 |
| (Color Developing Solution for Color Negative Film) | | |
| Water | 800 ml | 800 ml |
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 40.0 g |
| Potassium bromide | 1.4 g | 0.4 g |
| Potassium iodide | 1.5 mg | — |
| Hydroxylamine sulfate | 2.4 g | 3.0 g |
| 4-(N-Ethyl-N-beta-hydroxyethylamino)-2-methylaniline sulfate | 4.5 g | 6.5 g |
| Water | ad. 1000 ml | ad. 1000 ml |
| pH | 10.05 | 10.10 |
| (Bleach-fixing Solution: Common to C.N.F. and C.P.) | | |
| Water | 600 ml | 600 ml |
| Ferric ammonium ethylenediamine-tetraacetate dihydrate | 70 g | 80 g |
| Disodium ethylenediaminetraacetate | 10 g | 12 g |
| Sodium sulfite | 15 g | 20 g |
| 70% (w/v) Aqueous solution of ammonium thiosulfate | 240 ml | 260 ml |
| 98% Acetic acid | — | 3 ml |
| Bleaching accelerator | $5 \times 10^{-3}$ mole | $6 \times 10^{-3}$ mole |

-continued

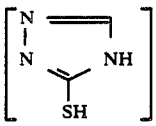

| | | |
|---|---|---|
| Water | ad. 1000 ml | ad. 1000 ml |
| pH | 6.5 | 6.2 |

| Component | Tank Soln. and Replenisher |
|---|---|
| (Water Washing Solution: Common to C.N.F. and C.P.) | |
| Deionized water* | 1000 ml |
| Sodium salt of chlorinated isocyanuric acid | 0.02 g |
| Surfactant (compound listed in Table II) | $5 \times 10^{-4}$ mole |

*Deionized water: This was obtained by passing tap water through a mixed bed column packed with H-type strong acidic cation exchange resin (available from Rohm & Haas Co. under the trade name of Amberlite IR-120B) and OH-type anion exchange resin (available from the same company under the trade name of Amberlite IR-400) to adjust the concentration of calcium and magnesium ions to 3 mg/l respectively.

Practically, the following processings No. 1 to No. 8 in which the washing water contained a surfactant in various concentrations were performed under the foregoing processing conditions, utilizing the aforesaid automatic developing machine. In each of the processings No. 1 to No. 8, the processing was commenced using fresh processing solutions and 200 m of the color negative films which had been photographed under standard exposure conditions in the open air and 600 m of the color paper which had been subjected to standard exposure through a color negative film carrying a standard image by a printer.

At the beginning and the end of each processing, an unexposed color paper was processed and the difference between the magenta stains of the color paper before and after the processing was determined. Moreover, the processed color paper was stored at 60° C., 70% RH for 3 weeks and the increase in the yellow stains during the storage was calculated from the reflection density of magenta and yellow measured by an Exlight 310 Photographic Densitometer. The results obtained are summarized in Table II.

In addition, the processed color negative films were examined with respect to the conditions thereof such as the contamination of the surface at the end of the processing and the results were likewise listed in Table II.

TABLE II

| Processing | Surfactant | Difference in magenta stains | Increase in yellow stains | Surface condition of C.N.F. |
|---|---|---|---|---|
| 1* | none | +0.04 | +0.03 | formation of water spots |
| 2* | Comp. compound (1) | +0.04 | +0.03 | adhesion of stains |
| 3* | Comp. compound (2) | +0.05 | +0.08 | adhesion of stains |
| 4* | Comp. compound (3) | +0.05 | +0.08 | adhesion of stains |
| 5 | Nonion (5) | +0.02 | +0.03 | No water spots and stains |
| 6 | Nonion (7) | +0.01 | +0.02 | No water spots and stains |
| 17 | Nonion (28) | +0.01 | +0.02 | No water spots and stains |
| 8 | Nonion (31) | +0.02 | +0.03 | No water spots and stains |

TABLE II-continued

*This means Comparative Example.

Comp. compound (1): Anionic surfactant $C_{12}H_{25}SO_3Na$

Comp. compound (2): Cationic surfactant

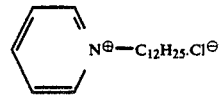

Comp. compound (3): Amphoteric surfactant

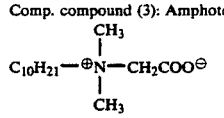

The results listed in Table II indicate that according to the present invention in which a nonionic surfactant was added to the processing solution, there is no increase in magenta stains and yellow stains even when a simultaneous processing was carried out. Moreover, the surface of the color negative films processed by method of the present invention using surfactants is clean and has good appearance.

EXAMPLE 2

The same procedures as in Example 1 were repeated except that all the overflow from the water washing process (1) in Example 1 was introduced into the bleach-fixing bath and that the amount replenished and part of the compositions of the processing solutions were changed as follows and that at the end of each processing, color paper which had been exposed to light (2854K-250CMS) was processed and the amount of residual silver was estimated by a fluorescent X-ray technique. The results obtained are listed in Table IV below.

TABLE III

| | Amount of processing Soln. Replenished* | |
|---|---|---|
| | C.N.F. | C.P. |
| Bleach-fixing | 340 ml | 100 ml |
| Water washing (1) | | |
| Water washing (2) | 400 ml** | 200 ml** |
| Water washing (3) | | |

*The amount replenished is expressed in the amount per 1 $m^2$.

**The replenisher was introduced into the water washing process (3) and the overflow therefrom in turn flowed into water washing processes (2) and (1) and the bleach-fixing process.

| (Composition of the Bleach-fixing Soln.: common to C.N.F. and C.P.) | | |
|---|---|---|
| Component | Tank Soln. | Replenisher |
| Water | 600 ml | 600 ml |
| Ferric ammonium ethylenediamine-tetraacetate dihydrate | 50 g | 120 g |
| Disodium ethylenediaminetetraacetate | 10 g | 24 g |
| Sodium sulfite | 15 g | 36 g |
| 70% (w/v) Aqueous solution of ammonium thiosulfate | 200 ml | 480 ml |
| 98% Acetic acid | — | 5 ml |
| Bleaching accelerator | $5 \times 10^{-3}$ mole | $1.2 \times 10^{-2}$ mole |

-continued

| (Composition of the Bleach-fixing Soln.: common to C.N.F. and C.P.) | | |
|---|---|---|
| Component | Tank Soln. | Replenisher |
| 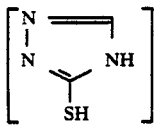 | | |
| Water | ad. 1000 ml | ad. 1000 ml |
| pH | 6.5 | 6.2 |

TABLE IV

| Processing | Surfactant | Difference in magenta stains | Increase in yellow stains | Amount of residual silver (microgram/cm) |
|---|---|---|---|---|
| 1* | none | +0.04 | +0.03 | 4.5 |
| 2* | Comp. compound (1) | +0.04 | +0.03 | 4.0 |
| 3* | Comp. compound (2) | +0.05 | +0.08 | 7.2 |
| 4* | Comp. compound (3) | +0.04 | +0.06 | 6.0 |
| 5 | Nonion (5) | +0.01 | +0.03 | 2.8 |
| 6 | Nonion (7) | ±0 | +0.02 | 2.2 |
| 7 | Nonion (28) | ±0 | +0.02 | 2.1 |
| 8 | Ninion (31) | +0.01 | +0.03 | 3.1 |

*: This means Comparative Example.

It was found, from the results summarized in Table IV, that if the surfactant was added to the bleach-fixing solution of the present invention, the magenta and yellow stains were further reduced compared with those observed in Example 1 and the amount of residual silver was also reduced.

EXAMPLE 3

Photographic color negative films having the following layer structure were prepared by applying coating solutions of the following compositions onto the surface of a substrate composed of a cellulose triacetate film to which an underlying coating had been applied.

Compositions of the Light-sensitive Layers

The coated amount of each component is expressed in g/m$^2$ and that of the silver halide is expressed in the reduced amount of elemental silver. Moreover, that of sensitizing dyes is expressed in that coated amount (moles) per mole of silver halide included in the same layer.

| | |
|---|---|
| 1st Layer: Halation Inhibiting Layer | |
| Black colloidal silver | 0.18 (Ag) |
| Gelatin | 0.40 |
| 2nd Layer: Intermediate Layer | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| 3rd Layer: First Red-sensitive Emulsion Layer | |
| Monodisperse silver iodobromide emulsion (AgI = 6 mole %; average grain size = 0.6 micron; Variation coefficient regarding the grain size (V.C.) = 0.15) | 0.55 (Ag) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |
| 4th Layer: Second Red-sensitive Emulsion Layer | |
| Tabular silver iodobromide emulsion (Ag = 10 mole %; average grain size = 0.7 micron; average aspect ratio = 5.5; average thickness = 0.2 micron) | 1.0 (Ag) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.050 |
| EX-10 | 0.015 |
| Gelatin | 1.30 |
| 5th Layer: Third Red-sensitive Emulsion Layer | |
| Silver iodobromide emulsion (AgI = 16 mole %; average grain size = 1.1 micron) | 1.60 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBC-2 | 0.10 |
| Gelatin | 1.63 |
| 6th Layer: Intermediate Layer | |
| EX-5 | 0.040 |
| HBS-1 | 0.020 |
| EX-12 | 0.004 |
| Gelatin | 0.80 |
| 7th Layer: First Green-sensitive Emulsion Layer | |
| Tabular silver iodobromide emulsion (AgI = 6 mole %; average grain size = 0.6 micron; average aspect ratio = 6.0; average thickness = 0.15 micron) | 0.40 (Ag) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| 8th Layer: Second Green-sensitive Emulsion Layer | |
| Monodisperse silver iodobromide emulsion (Ag = 9 mole %; average grain size = 0.7 micron; V.C. = 0.18) | 0.80 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| 9th Layer: Third Green-sensitive Emulsion Layer | |
| Silver iodobromide emulsion (AgI = 12 mole %; average grain size = 1.0 micron) | 1.20 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |

-continued

| | |
|---|---|
| 10th Layer: Yellow Filter Layer | |
| Yellow colloidal silver | 0.05 (Ag) |
| EX-5 | 0.08 |
| HBS-3 | 0.03 |
| Gelatin | 0.95 |
| 11th Layer: First Blue-sensitive Emulsion Layer | |
| Tabular silver iodobromide emulsion (AgI = 6 mole %; average grain size = 0.6 micron; average aspect ratio = 5.7; average thickness = 0.15 micron) | 0.24 (Ag) |
| Sensitizing dye VIII | $3.5 \times 10^{-4}$ |
| EX-9 | 0.85 |
| EX-8 | 0.12 |
| HBS-1 | 0.28 |
| Gelatin | 1.28 |
| 12th Layer: Second Blue-sensitive Emulsion Layer | |
| Monodisperse silver iodobromide emulsion (AgI = 10 mole %; average grain size = 0.8 micron; V.C. = 0.16) | 0.45 (Ag) |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| 13th Layer: Third Blue-sensitive Emulsion Layer | |
| Silver iodobromide emulsion (AgI = 14 mole %; average grain size = 1.3 micron) | 0.77 (Ag) |
| Sensitizing dye VIII | $2.2 \times 10^{-4}$ |
| EX-9 | 0.20 |
| HBS-1 | 0.07 |
| Gelatin | 0.69 |
| 14th Layer: First Protective Layer | |
| Silver iodobromide emulsion (AgI = 1 mole %; average grain size = 0.07 micron) | 0.5 (Ag) |
| U-4 | 0.11 |
| U-5 | 0.17 |
| HBS-1 | 0.90 |
| Gelatin | 1.00 |
| 15th Layer: Second Protective Layer | |
| Polymethylacrylate particles (average Particle size = 1.5 micron) | 0.54 |
| S-1 | 0.15 |
| S-2 | 0.05 |
| Gelatin | 0.72 |

To each layer there were added a gelatin hardening agent H-1 and a surfactant in addition to the foregoing components. Moreover, the structural formulas or chemical names of the compounds used in this Example are as follows:

U-1

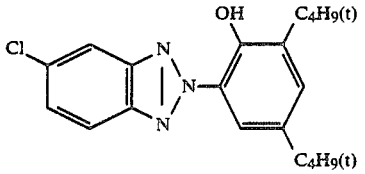

U-2

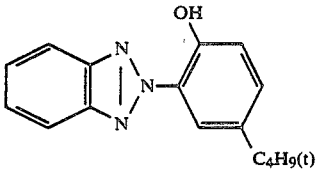

U-3

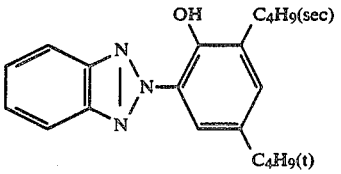

U-4

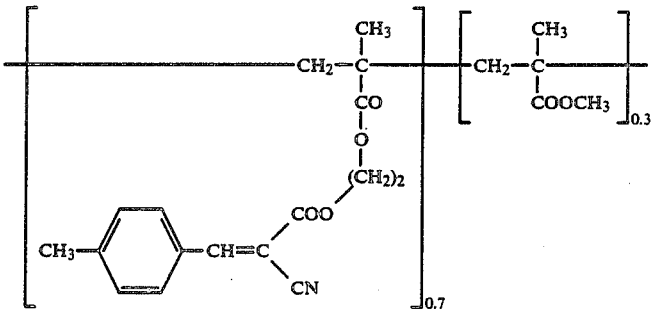

U-5

-continued
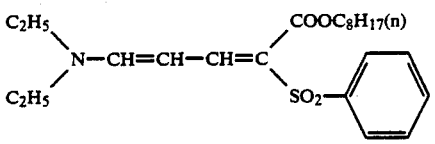
EX-1
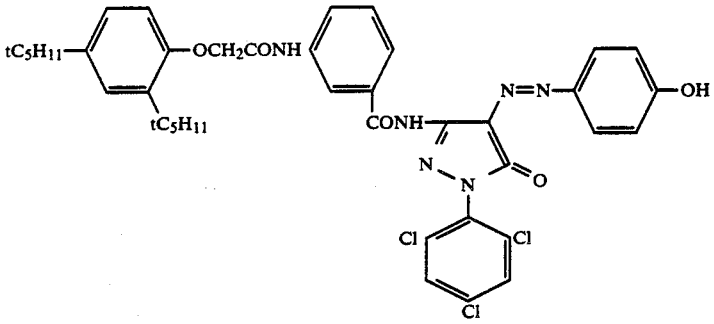
EX-2
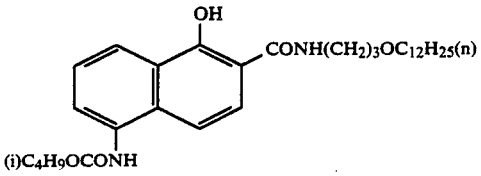
EX-3
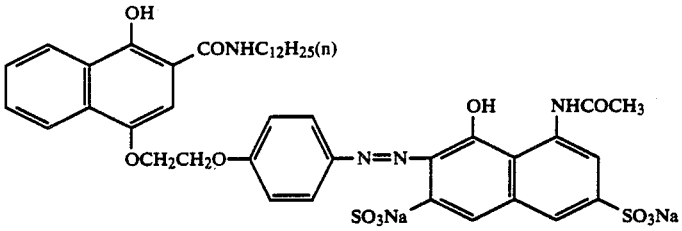
EX-4
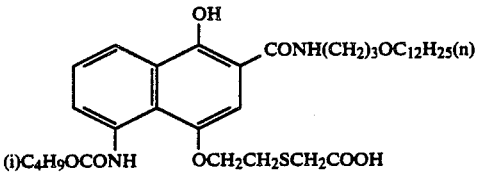
EX-5
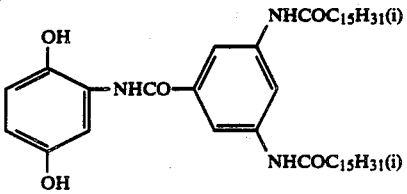
EX-6

-continued
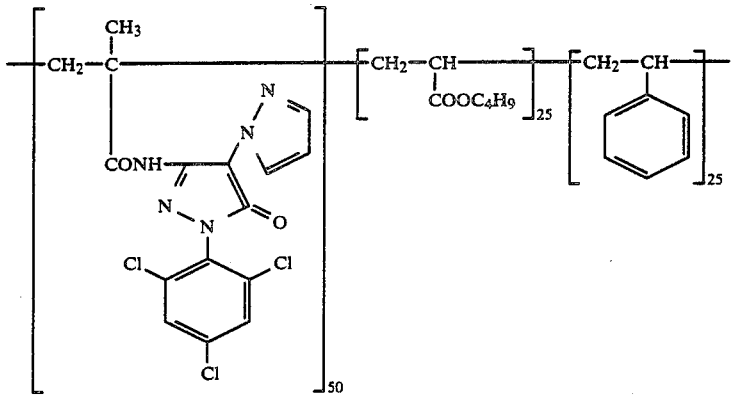
average molecular weight = 30,000
EX-7
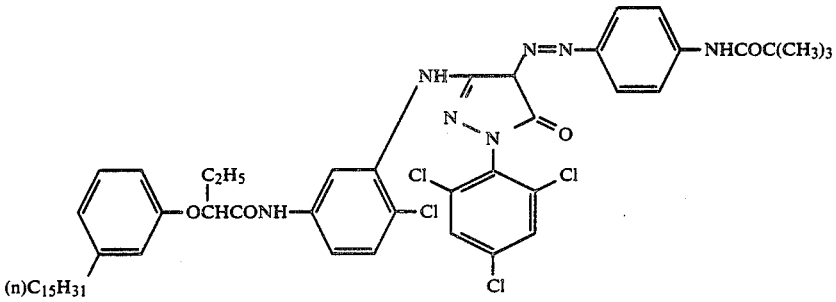
EX-8
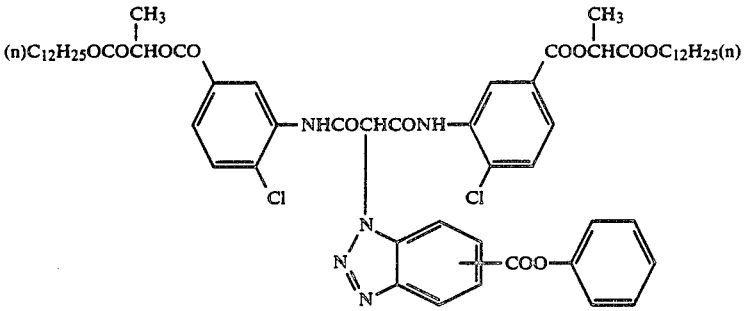
EX-9
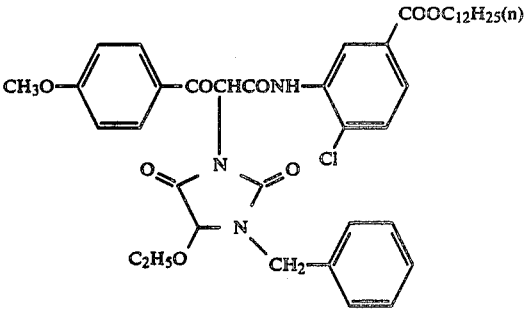
EX-10

-continued
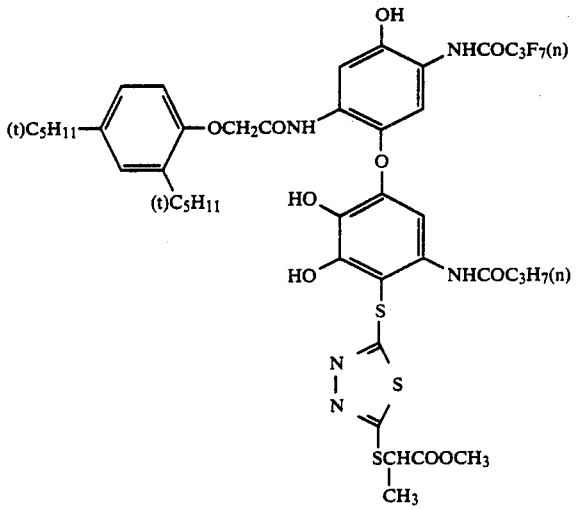
EX-11
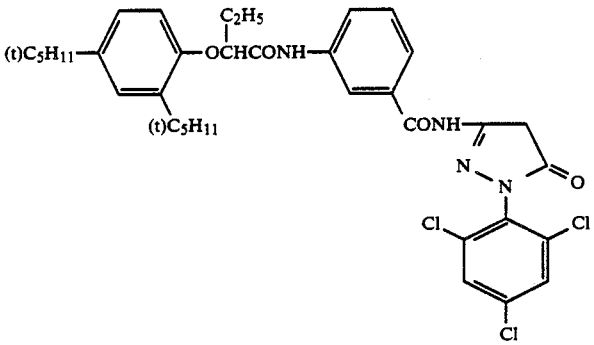
EX-12
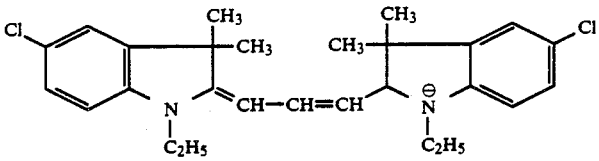
S-1
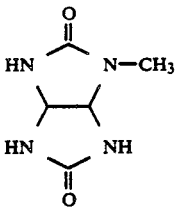
S-2
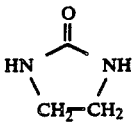
HBS-1: Tricresyl Phosphate
HBS-2: Dibutyl Phtharate
HBS-3: Bis(2-ethylhexyl)Phtharate
HBS-4

-continued
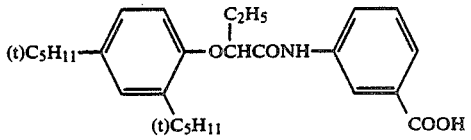
H-1
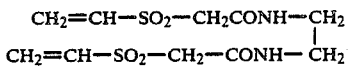
Sensitizing Dye I
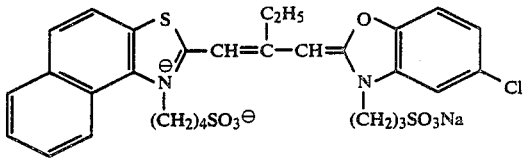
Sensitizing Dye II
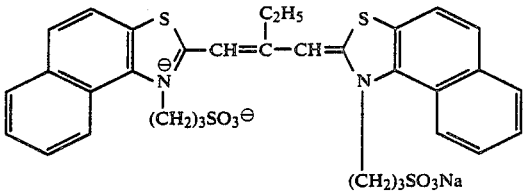
Sensitizing Dye III
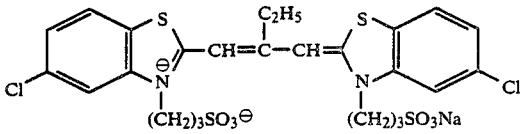
Sensitizing Dye IV
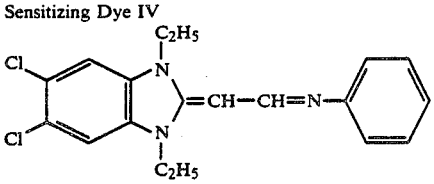
Sensitizing Dye V
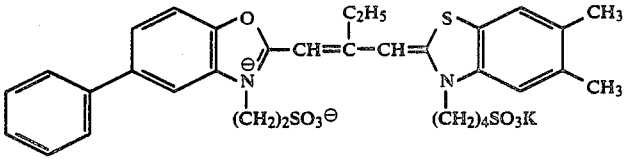
Sensitizing Dye VI
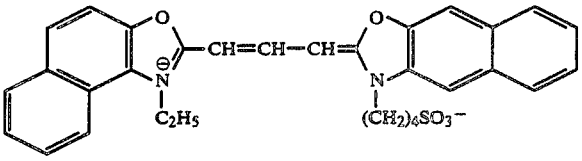
Sensitizing Dye VII
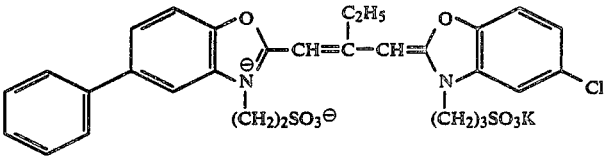

-continued

Sensitizing Dye VIII

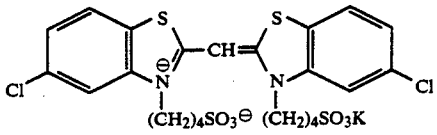

Sensitizing Dye IX

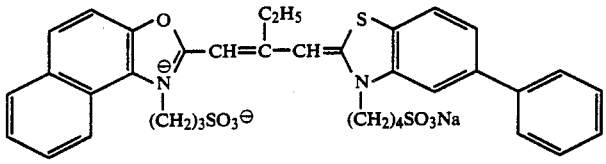

On the other hand, color paper for prints having the following layer structure was prepared by applying coating solutions having the following compositions onto the surface of paper substrate whose both sides had been laminated with polyethylene films. The coating solutions were prepared as follows;

Preparation of the Coating solution for First Layer

To 19.1 g of a yellow coupler (*ExY-1) and 4.4 g of a color image stabilizer (Cpd-1) were added 27.2 cc of ethyl acetate and 7.7 cc (8.0 g) of a high boiling point solvent (Solv-1) to dissolve the same Then, the resulting solution was dispersed in 185 cc of 10% gelatin aqueous solution containing 8 cc of 10% sodium dodecylbenzene sulfonate to form an emulsion. This emulsion was mixed with emulsions EM 7 and EM 8 and the concentration of gelatin was adjusted so as to be consistent with the following composition to thereby form a coating solution for a first layer. The coating solutions for 2nd to 7th layers were likewise prepared in the same manner as that for preparing the coating solution for the first layer. In each coating solution, sodium salt of 1-oxy-3,5-dichloro-s-triazine was used as a gelatin hardening agent. Morever, they contained Cpd-2 as a thickening agent.

Layer Structure

The composition of the coating solution for each layer is as follows. Each numerical value represents the coated amount of each component expressed in g/m$^2$. In this connection, the amount of silver halide emulsion is expressed in the reduced amount of elemental silver.

Substrate: Paper substrate laminated with polyethylene films(the polyethylene film on the side of the first layer contained a white pigment ($TiO_2$) and a blueing dye).

| | |
|---|---|
| 1st Layer: Blue-sensitive Emulsion Layer | |
| Monodisperse silver chlorobromide emulsion spectrally sensitized with a sensitizing dye (ExS-1) EM7 | 0.15 |
| Monodisperse silver chlorobromide emulsion spectrally sensitized with a sensitizing dye (ExS-1) EM8 | 0.15 |
| Gelatin | 1.86 |
| Yellow coupler ExY-1 | 0.82 |
| Color image stabilizer Cpd-2 | 0.19 |
| Solvent Solv-1 | 0.35 |
| 2nd Layer: Color Mixing Inhibiting Layer | |
| Gelatin | 0.99 |
| Color mixing inhibitor Cpd-3 | 0.08 |
| 3rd Layer: Green-sensitive Emulsion Layer | |
| Monodisperse silver chlorobromide emulsion spectrally sensitized with sensitizing dyes (ExS-2,3) EM9 | 0.12 |
| Monodisperse silver chlorobromide emulsion spectrally sensitized with sensitizing dyes (ExS-2,3) EM10 | 1.24 |
| Gelatin | 1.24 |
| Magenta coupler ExM-1 | 0.39 |
| Color image stabilizer Cpd-4 | 0.25 |
| Color image stabilizer Cpd-5 | 0.12 |
| Solvent Solv-2 | 0.25 |
| 4th Layer: Ultraviolet Absorbing Layer | |
| Gelatin | 1.60 |
| ultraviolet absorber (Cpd-6/Cpd-7/Cpd-8 = 3/2/6: weight ratio) | 0.70 |
| Color mixing inhibitor Cpd-9 | 0.05 |
| Solvent Solv-3 | 0.42 |
| 5th Layer: Red-sensitive Emulsion Layer | |
| Monodisperse silver chlorobromide emulsion spectrally sensitized with sensitizing dyes (ExS-4,5) EM11 | 0.07 |
| Monodisperse silver chlorobromide emulsion spectrally sensitized with sensitizing dyes (ExS-4,5) EM12 | 0.16 |
| Gelatin | 0.92 |
| Cyan coupler ExC-1 | 1.46 |
| Cyan coupler ExC-2 | 1.84 |
| Color image stabilizer (Cpd-7/Cpd-8/Cpd-10 = 3/4/2: weight ratio) | 0.17 |
| Polymer for dispersion Cpd-11 | 0.14 |
| Solvent solv-1 | 0.20 |
| 6th Layer: Ultraviolet Absorbing Layer | |
| Gelatin | 0.54 |
| Ultraviolet absorber (Cpd-6/Cpd-8/Cpd-10 = 1/5/3: weight ratio | 0.21 |
| Solvent Solv-4 | 0.08 |
| 7th Layer: Protective Layer | |
| Gelatin | 1.33 |
| Acrylic modified copolymer of polyvinyl alcohol(degree of modification = 17%) | 0.17 |
| Liquid paraffin | 0.03 |

In this connection, Cpd-12 and Cpd-13 were used as dyes for inhibiting irradiation.

Each layer further contained Alkanol XC (available from Dupont Co., Ltd), sodium alkylbenzene sulfonate, a succinate and megafac F-120 (available from DAI-NIPPON INK CHEMICALS. Inc.) as an emulsifying agent and a coating aid respectively.

The details of the emulsions used are as follows:

| Emulsion | Shape | Grain Size (micron) | Br content (mole %) | V.C.° |
|---|---|---|---|---|
| EM7 | cubic | 1.1 | 1.0 | 0.10 |
| EM8 | " | 0.8 | 1.0 | 0.10 |
| EM9 | " | 0.45 | 1.5 | 0.09 |
| EM10 | " | 0.34 | 1.5 | 0.09 |

-continued
| Emulsion | Shape | Grain Size (micron) | Br content (mole %) | V.C.* |
|---|---|---|---|---|
| EM11 | " | 0.45 | 1.5 | 0.09 |
| EM12 | " | 0.34 | 1.6 | 0.10 |
*Variation Coefficient (this represents the distribution of grains) = Standard Deviation/Average Size
The structural formulas of the compounds used in this Example are as follows:
ExY-1
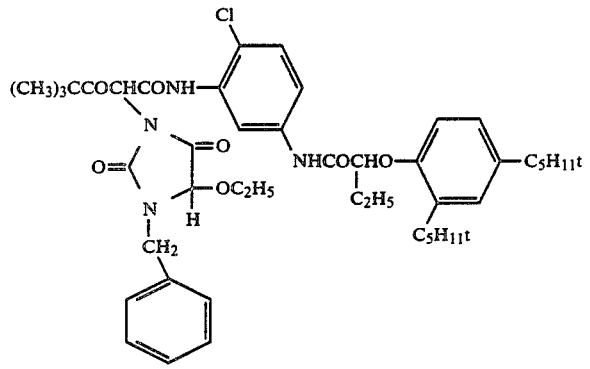
ExM-1
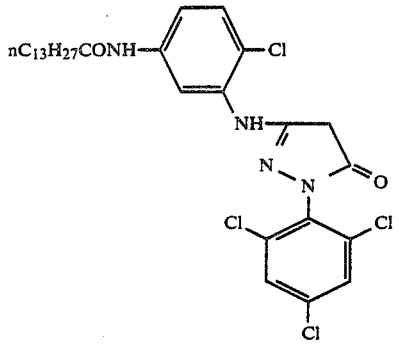
ExC-1
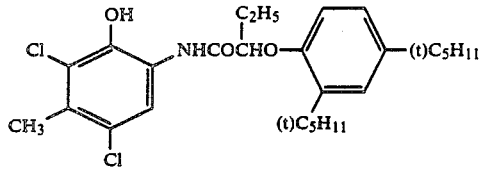
ExC-2
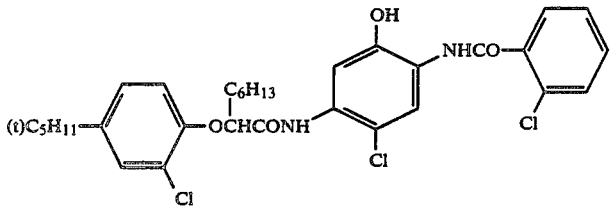
ExS-1
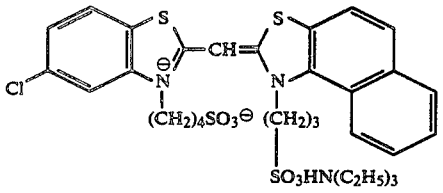

-continued
ExS-2
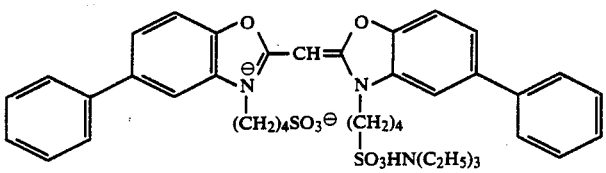
ExS-3
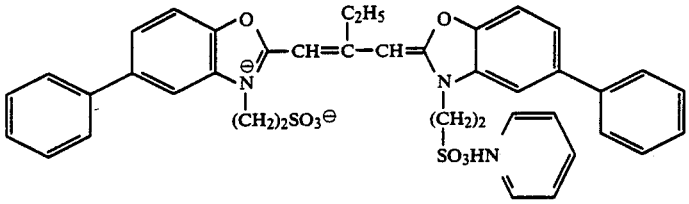
ExS-4
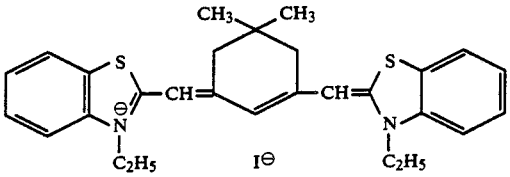
ExS-5
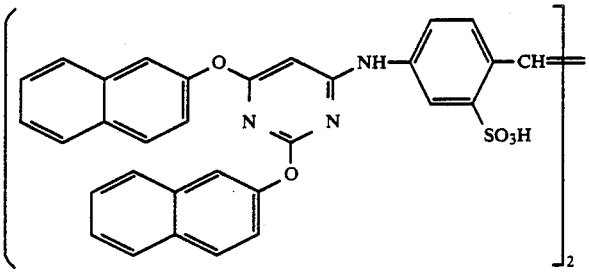
Cpd-1
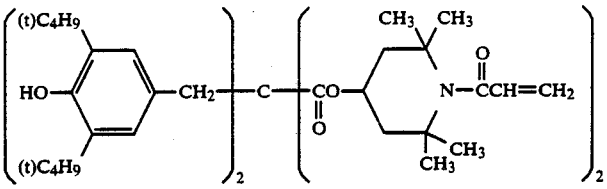
Cpd-2
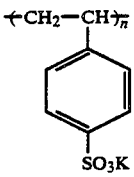
Cpd-3
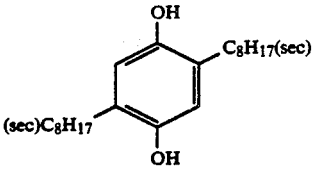
Cpd-4
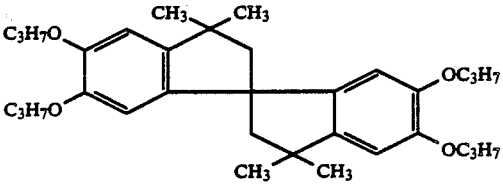

-continued
Cpd-5
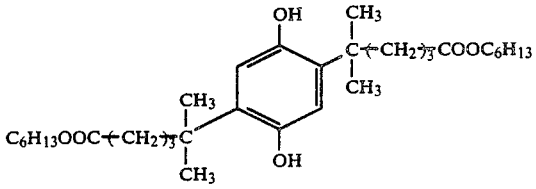
Cpd-6
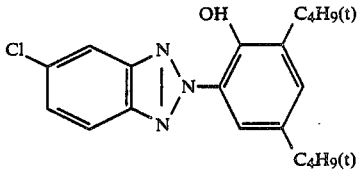
Cpd-7
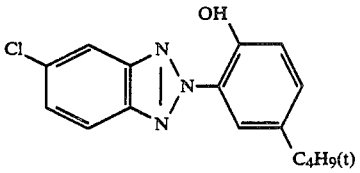
Cpd-8
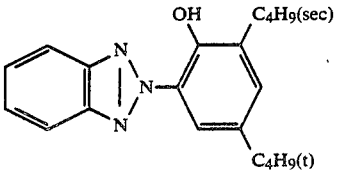
Cpd-9
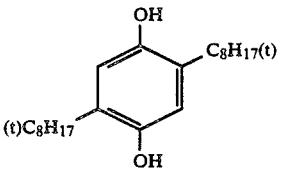
Cpd-10
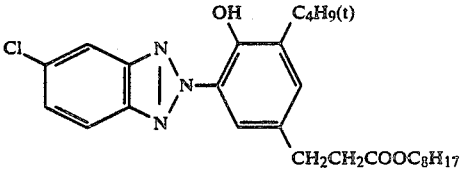
Cpd-11
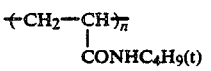
Cpd-12
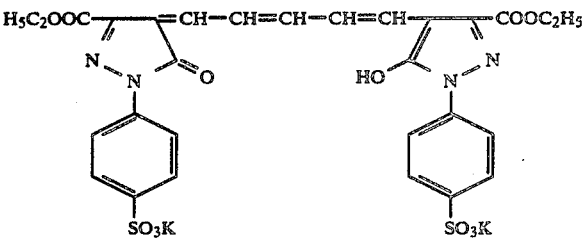

-continued

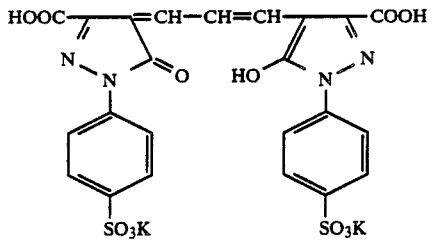

Cpd-13

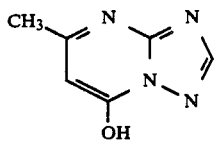

Cpd-14

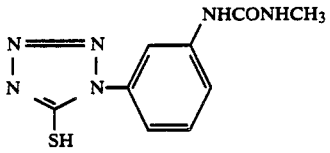

Cpd-15

Solv-1: Dibutyl Phtharate
Solv-2: Trioctyl Phtharate
Solv-3: Trinonyl Phosphate
Sovl-4: Tricresyl Phosphate These two kinds of color light-sensitive materials were processed in accordance with the processing conditions listed in Table V utilizing the same processing apparatus as in Example 1.

TABLE V

| Process | Temp. (°C.) | Processing Steps: Processing time (sec) C.N.F. | C.P. | Amount Replenished* C.N.F.(ml) | C.P.(ml) |
|---|---|---|---|---|---|
| Color development | 38/35*** | 195 | 45 | 400 | 220 |
| Bleach-fixing | 35 | 180 | 45 | 540 | 220 |
| Water washing(1) | 35 | 20 | 30 | | |
| Water washing(2) | 35 | 20 | 30 | 530** | 300** |
| Water washing(3) | 35 | 20 | 30 | | |
| Drying | 55/70*** | 60 | 50 | | |

*The amount replenished is expressed in the amount per 1 $m^2$ of the processed light-sensitive material.
**The water washing was carried out by a 3-tank countercurrent system from (3) to (1), therefore, replenisher was introduced into the water washing bath (3).
***The upper numeral means the processing temperature for the color negative film (C.N.F.) and the lower numeral means that for the color paper (C.P.).

The composition of the processing solutions used is as follows:

| Component | Tank Soln. (g) | Replenisher (g) |
|---|---|---|
| (Color Developer for Color Negative Film) | | |
| Water | 800 (ml) | 800 (ml) |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 40.0 |
| Potassium bromide | 1.4 | — |
| Potassium iodide | 1.5 (mg) | — |
| Hydroxylamine sulfate | 2.4 | 3.0 |
| 4-(N-ethyl-N-beta-hydroxyethylamino)-2-methylaniline sulfate | 4.5 | 7.5 |
| Water | ad. 1000 ml | ad. 1000 ml |
| pH | 10.05 | 10.10 |
| (Color Developer for Color Paper) | | |
| Water | 800 (ml) | 800 (ml) |
| Ethylenediamine-N,N,N',N'-tetramethylene phosphonic acid | 1.5 | 1.5 |
| Triethylenediamine(1,4-diazabicyclo(2,2,2)octane) | 5.0 | 5.0 |
| Sodium chloride | 1.4 | — |
| Potassium Carbonate | 25 | 25 |
| N-ethyl-N-(beta-methanesulfonamidoethyl)-3-methyl-4-aminoaniline sulfate | 5.0 | 7.0 |
| Diethylhydroxylamine | 4.2 | 6.0 |
| Fluorescent whitener (4,4'-diaminostilbene type) | 2.0 | 2.5 |
| Water | ad. 1000 ml | ad. 1000 ml |
| pH | 10.05 | 10.45 |
| (Bleach-fixing Solution: common to C.N.F. and C.P) | | |
| Water | 600 (ml) | 600 (ml) |
| Ferric ammonium ethylenediamine-tetraacetate dihydrate | 60 | 70 |
| Disodium ethylenediaminetetraacetate | 10 | 12 |
| Sodium sulfite | 15 | 20 |
| 70% (w/v) aqueous solution of ammonium thiosulfate | 220 (ml) | 240 (ml) |
| 98% Acetic acid | 5 (ml) | 7 (ml) |
| Bleaching accelerator | $5 \times 10^{-3}$ mole | $6 \times 10^{-3}$ mole |

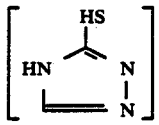

| | | |
|---|---|---|
| Water | ad. 1000 (ml) | ad. 1000 (ml) |
| pH | 6.0 | 5.7 |

| Component | Tank Soln. and Replenisher |
|---|---|
| (Water Washing Solution: common to C.N.F. and C.P.) | |
| Deionized water* | 1000 ml |
| Sodium salt of chlorinated isocyanurate | 0.02 g |

-continued

| | |
|---|---|
| Surfactant (see Table VI) | $3 \times 10^{-4}$ mole |

*Deionized water: This was obtained by passing tap water through a mixed bed column packed with H-type strong acidic cation exchange resin (available from Rohm & Haas Co. under the trade name of Amberlite IR-120B) and OH-type anion exchange resin (available from the same Company under the trade name of Amberlite IR-400) to adjust the concentration of calcium and magnesium ions to 3 mg/l or less respectively.

Practically, the following processings No. 1 to No. 8 were performed in the similar manner as in Example 1 except that the estimation of yellow stains was conducted after storing samples at 60° C., 70% RH for 2 weeks. The results obtained are summarized in Table VI.

TABLE VI

| Processing | Surfactant | Difference in magenta stains | Increase in yellow stains | Surface condition of C.N.F. |
|---|---|---|---|---|
| 1* | none | +0.04 | +0.10 | formation of water spots |
| 2* | comp. compound (4) | +0.04 | +0.11 | adhesion of stains |
| 3* | Comp. compound (2) | +0.05 | +0.20 | adhesion of stains |
| 4* | Comp. compound (3) | +0.05 | +0.15 | adhesion of stains |
| 5 | Nonion (5) | +0.02 | +0.09 | No water spots and stains |
| 6 | Nonion (7) | +0.01 | +0.08 | No water spots and stains |
| 7 | Nonion (28) | +0 | +0.08 | No water spots and stains |
| 8 | Nonion (31) | +0.02 | +0.09 | No water spots and stains |

*; This means comparative Example.

Comp. Compounds (2) to (31) are the same as those used in Example 1 (refer to the footnote of Table II).

Comp. Compound (4):

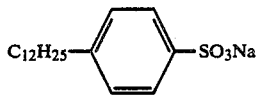

The results listed in Table VI indicate that according to the present invention (Test No. 5 to 8) in which a nonionic surfactant was added to the processing solution, there is no increase in magenta stains and yellow stains even when a simultaneous processing was carried out. Moreover, the surface conditions of the color negative films processed by the method of the present invention is quite excellent.

EXAMPLE 4

The same procedures as in Examples 1 to 3 were repeated except that the water washing solutions were replaced with a stabilization solution having the following composition and it was found that, as the results summarized in Tables II, IV and V, the magenta stains and the yellow stains observed after storing at 60° C. and 70% RH are greatly reduced by incorporating a surfactant into the stabilization solution as well as the bleach-fixing solution and that no stains of the color negative films are observed.

(Stabilization Solution: common to C.N.F. and C.P.)

| component | Tank Soln. and Replenisher |
|---|---|
| Water | 1000 ml |
| Formalin (37%) | 1.0 ml |
| 5-Chloro-2-methyl-4-isothiazoiin-3-one | 3.0 mg |
| Surfactant (compounds listed in Table II of Example 1) | $5 \times 10^{-4}$ mole |
| 1-Hydroxyethylidene-1,1-diphosphonic acid | 1.5 g |
| Copper sulfate | 0.005 g |
| pH (adjusted by adding aqueous ammonia) | 7.0 |

EXAMPLE 5

The color negative film (3.5 mm wide) and the color paper (82.5 mm wide) described in Example 3 were simultaneously processed under the conditions summarized in Table VII utilizing the automatic developing machine shown in FIG. 2 in which all the processing baths are used in common in processing these two kinds of light-sensitive materials.

TABLE VII

| | | Processing Steps | | | |
|---|---|---|---|---|---|
| | | Processing time (sec) | | Amount Replenished* | |
| Process | Temp. (°C.) | C.N.f. | C.P. | C.N.F.(ml) | C.P.(ml) |
| Color development | 38 | 120 | 45 | 540 | 200 |
| Bleach fixing | 38 | 120 | 45 | 540 | 120 |
| Water washing(1) | 35 | 30 | 30 | | |
| Water washing(2) | 35 | 30 | 30 | 400** | 240** |
| Water washing(3) | 35 | 30 | 30 | | |
| Drying | 65 | 60 | 45 | | |

*The amount replenished is expressed in the amount per 1 $m^2$ of the processed light-sensitive material.
**The water washing was carried out by 3-tank countercurrent system from (3) to (1) and the replenisher was introduced into the water washing bath (3).

(Color Developer)

| Component | Tank Soln. (g) | Replenisher (g) |
|---|---|---|
| Water | 800 (ml) | 800 (ml) |
| Ethylenediamine-N,N,N',N'-tetramethylene phosphonic acid | 1.5 | 1.5 |
| Triethylenediamine-(1,4-diazabicyclo(2,2,2)octane) | 5.0 | 5.0 |
| Sodium chloride | 1.4 | — |
| Potassium carbonate | 25 | 25 |
| N-ethyl-N-(beta-methanesulfonamidoethyl)-3-methyl-4-aminoaniline sulfate | 5.0 | 7.0 |
| Diethylhydroxylamine | 4.2 | 6.0 |
| Fluorescent whitener (4,4'-diaminostilbene type) | 2.0 | 2.5 |
| Water | ad. 1000 ml | ad. 1000 ml |
| pH | 10.05 | 10.45 |

(Bleach-fixing solution)

| Component | Tank soln. and Replenisher (g) |
|---|---|
| Water | 600 (ml) |
| Ferric ammonium ethylenediaminetetraacetate dihydrate | 60.0 |
| Disodium ethylenediaminetetraacetate | 5.0 |
| Sodium sulfite | 12.0 |
| 70% (w/v) aqueous solution of ammonium thiosulfate | 260.0 (ml) (1.23 mole) |
| 98% Acetic acid | 5.0 (ml) |
| Ammonium bromide | 50.0 |

-continued

| | |
|---|---|
| Surfactant (compounds listed in Table VIII | $1 \times 10^{-4}$ mole |
| Water | ad. 1000 (ml) |
| pH (at 25° C.) | 6.0 |

(Water Washing Solution)

| Component | Tank soln. and Replenisher |
|---|---|
| Deionized water* | 1000 ml |
| Sodium dichloroisocyanurate | 0.02 g |
| Surfactant (compound listed in Table VIII) | $1 \times 10^{-4}$ mole |

*Deionized water: This was obtained by passing tap water through a mixed bed column packed with a strong basic anion exchange resin and a strong acidic cation exchange resin.

The electrical conductivity thereof was 1.0 micro S/cm at 25° C.

In the same manner as described above, processings Nos. 1 to 10 were performed while altering the kind of surfactant contained in the water washing and bleach-fixing solutions.

Each processing No. 1 to No. 10 was commenced using fresh processing solutions and 300 m of the foregoing color m-negative film which had been photographed in the open air under standard exposure conditions and 600 m of the color paper which had been subjected to standard exposure through a color negative film carrying standard images by a printer were processed.

Except for the foregoing points, the same procedures as in Example 1 were repeated to prepare test samples and thus the difference between magenta stains observed before and after the processing as well as the increase in yellow stains observed after storing at 60° C. and 70% RH for 3 weeks were estimated. The results obtained are listed in Table VIII.

TABLE VIII

| Processing | Surfactant: Washing solution | Surfactant: Bleach-fixing Soln. | Difference in magenta stains | Increase in yellow stains |
|---|---|---|---|---|
| 1* | none | none | +0.06 | +0.11 |
| 2* | Comp. compound (1) | the same Comp. (1) | +0.05 | +0.10 |
| 3* | Comp. compound (2) | the same Comp. (2) | +0.08 | +0.25 |
| 4* | Comp. compound (3) | the same Comp. (3) | +0.07 | +0.18 |
| 5 | Nonion (5) | none | +0.03 | +0.08 |
| 6 | Nonion (5) | the same Nonion (5) | +0.01 | +0.08 |
| 7 | Nonion (8) | none | +0.03 | +0.09 |
| 8 | Nonion (29) | none | +0.04 | +0.09 |
| 9 | Nonion (29) | the same Nonion (29) | +0.01 | +0.10 |
| 10 | Ninion (34) | the same Nonion (34) | +0.02 | +0.10 |

*This means Comparative Example.

The results listed in Table VIII indicate that according to the present invention, there is observed no increase in magenta stains and yellow stains even when a simultaneous processing was carried out in all the processes inclusive of the color development process. In particular, the magenta stains were further reduced when a nonionic surfactant was added to the bleach-fixing solution in addition to the water washing solution.

EXAMPLE 6

The same procedures as in Example 1 were repeated except for using a nonionic surfactant (2),(10), (15), (30), (33) or (38) instead of surfactant (5). Thus, almost the same results were observed.

What is claimed is:

1. A method for processing at least 2 kinds of silver halide color photographic light-sensitive materials comprising the steps of development, bleach-fixing, and water washing and/or stabilization, wherein the method further comprises processing, in a common bleach-fixing bath and a common water washing or stabilization bath directly subsequent thereto, one silver halide color photographic light sensitive material having, applied to a substrate, a silver halide emulsion layer which contains, on average, not less than 3 mol % of silver iodide and another silver halide color photographic light sensitive material having, applied to a substrate, a silver halide emulsion layer which is substantially free of silver iodide, wherein the water washing or stabilization bath contains at least one nonionic surfactant and the amount of replenisher for the bleach-fixing bath and the water washing or stabilization bath is reduced to not more than 400 ml/m$^2$ for color paper or not more than 800 ml/m$^2$ for color negative film.

2. The method according to claim 1 wherein the bleach-fixing bath contains at least one nonionic surfactant.

3. The method according to claim 2 wherein the amount of the nonionic surfactant ranges from $1 \times 10^{-5}$ to $5 \times 10^{-3}$ per liter of the bleach-fixing solution.

4. The method according to claim 2 wherein the nonionic surfactant is added to the bleach-fixing bath by introducing overflow from the water washing or stabilization bath into the bleach-fixing bath.

5. The method according to claim 1 wherein the bleach-fixing bath and the water washing or stabilization bath contain at least one nonionic surfactant.

6. The method according to claim 5 wherein the amount of the nonionic surfactant ranges from $1 \times 10^{-5}$ to $5 \times 10^{-3}$ per liter of the bleach-fixing solution and the water washing or stabilization solution, respectively.

7. The method according to claim 1 wherein the nonionic surfactant is a member selected from the group consisting of those represented by the following general formula(I):

$$R—O—(CH_2CH_2O)_p—H \quad (I)$$

wherein R represents an alkyl, alkenyl, aryl or alkylcarbonyl group and p represents an integer of 3 to 100.

8. The method according to claim 7 wherein the nonionic surfactant is a member selected from the group consisting of those represented by the general formula (I) in which R is an aryl group or an alkyl group having 5 to 20 carbon atoms and p is an integer ranging from 5 to 50.

9. The method according to claim 1 wherein the water washing or stabilization process comprises a plurality of baths and a replenisher therefor is introduced thereinto in a countercurrent manner.

10. The method according to claim 1 wherein the content of silver iodide in said one color light-sensitive material rages from 3 to 25 mole %.

11. The method according to claim 1 wherein said one color light-sensitive material and said other color light-sensitive material are processed in separate bleach-fixing baths, the overflow from one bath being passed into the other bath.

12. The method according to claim 1 wherein said one color light-sensitive material and said other color light-sensitive material are simultaneously processed in the common baths.

13. The method according to claim 1 wherein said one color light-sensitive material and said other color light-sensitive material are successively processed.

14. The method according to claim 1 wherein the color light-sensitive materials are simultaneously processed in a common developing bath.

15. A method for processing at least 2 kinds of silver halide color photographic light-sensitive materials comprising the steps of development, bleach-fixing, water washing and/or stabilization, wherein the method further comprises processing, in a common bleach-fixing bath and a common water washing or stabilization bath directly subsequent thereto, one silver halide color photographic light sensitive material having, applied to a substrate, a silver halide emulsion layer which contains, on average, not less than 3 mol % of silver iodide and another silver halide color photographic light sensitive material having, applied to a substrate, a silver halide emulsion layer which is substantially free of silver iodide, the bleach-fixing bath and the water washing bath or the bleach-fixing bath and the stabilization bath containing at least one nonionic surfactant represented by the following general formula (I) in an amount of $1\times10^{-5}$ to $5\times10^{-3}$ moles per liter, $$R—O—(CH_2CH_2O)_p—H \quad (I)$$

wherein R represents an alkyl, alkenyl, aryl or alkylcarbonyl group and p represents an integer of 3 to 100, and the amount of replenisher for the bleaching-fixing bath and the water washing or stabilization bath being reduced to not more than 400 ml/m$^2$ for color paper or not more than 800 ml/m$^2$ for color negative film.

* * * * *